US012030124B2

(12) United States Patent
Hayashi et al.

(10) Patent No.: US 12,030,124 B2
(45) Date of Patent: Jul. 9, 2024

(54) SIZING DEVICE

(71) Applicant: Sumitomo Electric Sintered Alloy, Ltd., Takahashi (JP)

(72) Inventors: Shinji Hayashi, Takahashi (JP); Kenji Takeuchi, Takahashi (JP)

(73) Assignee: SUMITOMO ELECTRIC SINTERED ALLOY, LTD., Takahashi (JP)

( * ) Notice: Subject to any disclaimer, the term of this patent is extended or adjusted under 35 U.S.C. 154(b) by 975 days.

(21) Appl. No.: 17/013,862

(22) Filed: Sep. 8, 2020

(65) Prior Publication Data

US 2020/0398342 A1 Dec. 24, 2020

Related U.S. Application Data

(63) Continuation-in-part of application No. PCT/JP2018/009653, filed on Mar. 13, 2018.

(51) Int. Cl.
*B22F 3/24* (2006.01)
*B22F 3/03* (2006.01)

(52) U.S. Cl.
CPC . *B22F 3/24* (2013.01); *B22F 3/03* (2013.01)

(58) Field of Classification Search
CPC ..... B30B 11/08; B30B 11/005; B30B 11/02; B30B 11/085; B24F 3/03; B24F 3/033; B24F 3/24
USPC ..... 72/370.1, 13
See application file for complete search history.

(56) References Cited

U.S. PATENT DOCUMENTS 5,223,192 A * 6/1993 Hinzpeter ..... B30B 11/005 425/149
2003/0143300 A1* 7/2003 Scholz ..... B30B 15/022 425/173
2003/0161907 A1* 8/2003 Hinzpeter ..... B30B 11/08 425/162

(Continued)

FOREIGN PATENT DOCUMENTS

CN 103658643 A 3/2014
CN 107708894 A 2/2018
DE 202005017516 U1 * 2/2006 ..... B30B 11/005

(Continued)

OTHER PUBLICATIONS

International Search Report and Written Opinion mailed on Jul. 3, 2018 for PCT/JP2018/009653 filed on Mar. 13, 2018, 6 pages including English Translation of the International Search Report.

*Primary Examiner* — Christopher L Templeton
*Assistant Examiner* — P Derek Pressley
(74) *Attorney, Agent, or Firm* — XSENSUS LLP

(57) ABSTRACT

In a sizing device equipped with a turntable having a plurality of accommodation holes that accommodate workpieces, carrying the workpiece in each of the accommodation holes to a through hole of a die disposed at a workpiece shaping position one by one, and causing the workpiece to be pressed by upper and lower punches, while each of the accommodation holes is moved from a workpiece supply position to a workpiece taking-out position by the turntable being rotated about a rotation axis, the sizing device includes a plurality of identification information holding units, a supply-side input unit, a shaping position read unit, a punch control unit, and a shaping position input unit.

19 Claims, 7 Drawing Sheets

(56) References Cited

U.S. PATENT DOCUMENTS

| | | | | |
|---|---|---|---|---|
| 2014/0083248 | A1* | 3/2014 | Ludemann | B23Q 16/001 74/813 C |
| 2019/0217388 | A1 | 7/2019 | Take | |

FOREIGN PATENT DOCUMENTS

| | | | | | |
|---|---|---|---|---|---|
| JP | 61-30605 | A | * | 2/1986 | |
| JP | H-07294581 | A | * | 11/1995 | E05B 15/004 |
| JP | 2011-080113 | A | | 4/2011 | |
| JP | 2013-174450 | A | | 9/2013 | |

* cited by examiner

SIZING DEVICE

CROSS-REFERENCE TO RELATED APPLICATION

The present application is a continuation-in-part of PCT filing PCT/JP2018/009653, filed Mar. 13, 2018, the entire contents of which are incorporated herein by reference.

TECHNICAL FIELD

The present disclosure relates to a sizing device.

BACKGROUND ART

A sizing device disclosed in Patent Literature (PTL) 1 is known as a device for correcting sizes of sintered bodies in a production process for sintered parts. The disclosed sizing device includes a turntable having a plurality of workpiece accommodation holes that accommodate the sintered parts, the turntable being rotated about a rotation axis. With the rotation of the turntable, the workpiece accommodation holes are each moved to a workpiece loading portion, a pressing portion (above a die), and a workpiece unloading portion in sequence one by one. The sintered part as a sizing target is taken into the workpiece accommodation hole in the workpiece loading portion, is carried to the pressing portion, and is pressed for sizing by upper and lower punches that are inserted into a die. The sintered part after the sizing is received by the workpiece accommodation hole again and is carried to the workpiece unloading portion.

CITATION LIST

Patent Literature

PTL 1: Japanese Unexamined Patent Application Publication No. 2011-080113

SUMMARY

A sizing device according to the present disclosure is equipped with a turntable having a plurality of accommodation holes that accommodate workpieces, carrying the workpiece in each of the accommodation holes to a through hole of a die disposed at a workpiece shaping position one by one, and causing the workpiece to be pressed by upper and lower punches that are vertically movable, while each of the accommodation holes is moved from a workpiece supply position to a workpiece taking-out position by the turntable being rotated about a rotation axis, the sizing device including:

a plurality of identification information holding units that correspond to the accommodation holes of the turntable and store tag codes;

a supply-side input unit that inputs a tag code to the identification information holding unit corresponding to the accommodation hole at the workpiece supply position when the workpiece is accommodated into the accommodation hole at the workpiece supply position:

a shaping position read unit that reads a tag code in the identification information holding unit corresponding to the accommodation hole at the workpiece shaping position;

a punch control unit that controls driving of the upper and lower punches to be inserted into the through hole of the die and to press the workpiece in the through hole in accordance with the tag code read by the shaping position read unit; and a shaping position input unit that inputs a new tag code to the identification information holding unit corresponding to the accommodation hole at the workpiece shaping position upon completion of pressing by the upper and lower punches.

DESCRIPTION OF EMBODIMENTS

Figure 1:
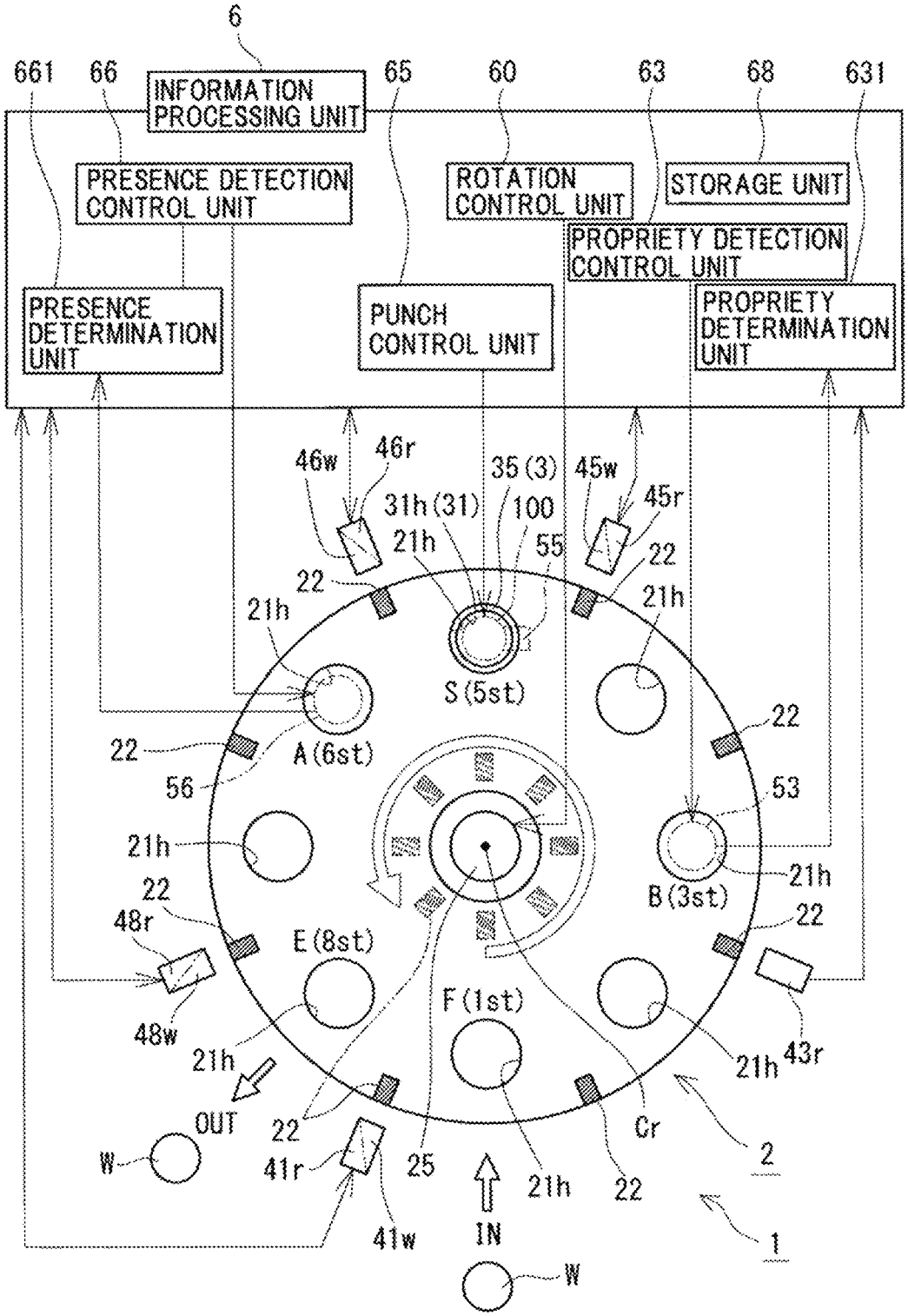
FIG. 1 is a schematic structural view of a sizing device according to an exemplary embodiment.

Solutions to Problems to be Solved by Present Disclosure

Usually, as recognized by the present inventor, when the turntable is stopped due to a malfunction, workpieces on the turntable are all recovered without being carried to the downstream side in the sizing device. This is because the turntable is manually moved from the stopped position to a proper position at the time of restarting the turntable, but there is a possibility that the turntable may be moved to an improper position by mistake. In other words, if the turntable is moved to the improper position and is restarted in such a state without recovering the workpieces, unsized products having not been subjected to and sizing operations and multiple-sized products having been subjected to sizing multiple times are produced. By recovering all the workpieces on the turntable, the unsized products and the multiple-sized products can be avoided from being carried to the downstream side. However, the manual work of recovering the workpieces on the turntable each time the turntable is stopped during the rotation is very troublesome.

One aspect of the present disclosure is to provide a sizing device that can avoid the unsized products and the multiple-sized products from being carried to the downstream side, without the need to manually recover the workpieces on the turntable.

Advantageous Effects of Present Disclosure

The sizing device according to the present disclosure can avoid the unsized products and the multiple-sized products from being carried to the downstream side, without the need to manually recover the workpieces on the turntable

Explanation of Embodiments

Without limiting the scope of any of the disclosed embodiments, a brief summary of selected aspects of selected embodiments are summarized as follows.

(1) According to an embodiment of the present disclosure, there is provided a sizing device equipped with a turntable having a plurality of accommodation holes that accommodate workpieces, carrying the workpiece in each of the accommodation holes to a through hole of a die disposed at a workpiece shaping position one by one, and causing the workpiece to be pressed by upper and lower punches that are vertically movable, while each of the accommodation holes is moved from a workpiece supply position to a workpiece taking-out position by the turntable being rotated about a rotation axis, the sizing device including:

a plurality of identification information holding units that correspond to the accommodation holes of the turntable and store tag codes;

a supply-side input unit that inputs a tag code to the identification information holding unit corresponding to the accommodation hole at the workpiece supply position when the workpiece is accommodated into the accommodation hole at the workpiece supply position;

a shaping position read unit that reads a tag code in the identification information holding unit corresponding to the accommodation hole at the workpiece shaping position;

a punch control unit that controls driving of the upper and lower punches to be inserted into the through hole of the die and to press the workpiece in the through hole in accordance with the tag code read by the shaping position read unit; and a shaping position input unit that inputs a new tag code to the identification information holding unit corresponding to the accommodation hole at the workpiece shaping position upon completion of pressing by the upper and lower punches. It should be noted that the use of the term "unit" is intended to construe a structural mechanical element (e.g., such as a metallic object), and/or a circuit/circuitry (e.g., control unit) that implements computer logic to execute an algorithm or operation, such as the circuitry described in FIG. 7.

With the above-described feature, unsized products having not been subjected to sizing and multiple-sized products having been subjected to sizing multiple times can be avoided from being carried to the downstream side in the sizing device with no need of the manual work of recovering the workpieces on the turntable. Since tag codes are assigned to all the workpieces each of which is accommodated into the accommodation hole at the workpiece supply position, whether the workpiece is a press completed product or not can be determined in accordance with whether the new tag code is input. As a result, the unsized products having not been subjected to the sizing can be avoided from being carried to the downstream side. Furthermore, the multiple-time sizing can be avoided in advance, and production of the multiple-sized products having been subjected to the sizing multiple times can be avoided. As a result, the multiple-sized products can be avoided from being carried to the downstream side.

(2) According to another embodiment, the above-described sizing device further includes a pressure measurement unit that measures pressing force of the punches, wherein the new tag code input by the shaping position input unit is a tag code in accordance with a value measured by the pressure measurement unit.

With the above-described feature, the tag code in accordance with the value measured by the pressure measurement unit can be set as a tag code indicating that the pressing force applied by the upper and lower punches is within a setting range, that it is over an upper limit of the setting range, or that it is below a lower limit of the setting range. By checking which tag code is input as the new tag code, therefore, it can be determined that the workpiece having been pressed by the upper and lower punches for the sizing is which one of a sizing-pressure proper product that has been pressed with the desired pressing force, a sizing-pressure excessive product that has been excessively pressed, and a sizing-pressure insufficient product that has been insufficiently pressed.

(3) According to still another embodiment, in the above-described sizing device, the shaping position input unit inputs a new tag code to the identification information holding unit corresponding to the accommodation hole at the workpiece shaping position when the driving of the upper and lower punches is started.

With the above-described feature, it is possible to detect the event that, after the upper and lower punches have started the driving, the punches are stopped due to malfunction before the timing of actually pressing the workpiece. Therefore, the occurrence of malfunction in the upper and lower punches can be detected.

(4) According to still another embodiment, the above-described sizing device further includes:

a post-shaping read unit that reads a tag code input to the identification information holding unit corresponding to the accommodation hole that is located downstream of the workpiece shaping position and upstream of the workpiece taking-out position;

a presence detection unit that detects, based on a result read by the post-shaping read unit, presence, or absence of the workpiece in the accommodation hole corresponding to the identification information holding unit from which the tag code has been read by the post-shaping read unit; and a rotation control unit that stops rotation of the turntable in accordance with a detection result of the presence detection unit, in addition to the punch control unit that stops vertical movements of the upper and lower punches in accordance with the detection result of the presence detection unit.

With the above-described feature, whether the workpiece having been pressed by the upper and lower punches remains sticking to the upper punch can be determined. Therefore, the next workpiece can be prevented from being pressed by the upper punch to which the preceding workpiece remains sticking. The reason is as described below Since the presence detection unit is disposed downstream of the workpiece shaping position and the sizing device includes the rotation control unit that stops rotation of the turntable in accordance with a detection result of the presence detection unit and the punch control unit that stops the vertical movements of the upper and lower punches in accordance with the detection result of the presence detection unit, the rotation of the turntable and the vertical movements of the upper and lower punches can be stopped before the next sizing is performed in the state in which the workpiece remains sticking to the upper punch. The presence detection unit detects the "absence of the workpiece" when the turntable is normally rotated while the workpiece remains sticking to the upper punch.

(5) According to still another embodiment, the above-described sizing device including the presence detection unit further includes:

a post-shaping input unit that inputs, in accordance with the detection result of the presence detection unit, a new tag code to the identification information holding unit corresponding to the accommodation hole that has been subjected to the detection by the presence detection unit.

With the above-described feature, the workpiece sticking to the upper punch can be detected. This is because a preset symbol implying the "absence of the workpiece in the accommodation hole" can be input as the new tag code.

(6) According to still another embodiment, the above-described sizing device further includes:

a pre-shaping read unit that reads a tag code input to the identification information holding unit corresponding to the accommodation hole that is located downstream of the workpiece supply position and upstream of the workpiece shaping position;

a propriety detection unit that detects, based on a result read by the pre-shaping read unit, whether an accommodation state of the workpiece in the accommodation hole corresponding to the identification information holding unit from which the tag code has been read by the pre-shaping read unit is proper or not; and a rotation control unit that stops rotation of the turntable in accordance with a detection result of the propriety detection unit, in addition to the punch control unit that stops vertical movements of the upper and lower punches in accordance with the detection result of the presence detection unit.

With the above-described feature, the workpiece accommodated in the improper state can be prevented from being carried to the workpiece shaping position. Therefore, the sizing of the workpiece accommodated in the improper state can be prevented. The reason is as described below. Since the propriety detection unit is disposed upstream of the workpiece shaping position and the sizing device includes the rotation control unit that stops rotation of the turntable in accordance with the detection result of the propriety detection unit and the punch control unit that stops the vertical movements of the upper and lower punches in accordance with the detection result of the presence detection unit, the workpiece accommodated in the improper state can be detected before it is carried to the workpiece shaping position, and the turntable and the upper and lower punches can be stopped. The propriety detection unit detects the "workpiece accommodated in the improper state" when the turntable is normally rotated in spite of that the workpiece is accommodated in the state in which a phase (particular position in the circumferential direction) of the workpiece is deviated relative to the accommodation hole at the workpiece supply position, that the workpiece is accommodated in an inclined posture, that the workpiece is accommodated in an upside-down posture, that several workpieces are accommodated together, or that the workpiece having an improper shape is accommodated.

(7) According to still another embodiment, the above-described sizing device further includes:

a taking-out-side read unit that reads a tag code input to the identification information holding unit corresponding to the accommodation hole at the workpiece taking-out position; and a storage unit that stores the tag code having been read by the taking-out-side read unit.

With the above-described feature, history of a product after the sizing can be grasped from the tag code corresponding to each workpiece.

(8) According to still another embodiment, the above-described sizing device further includes a die set that includes the die and the upper and lower punches, wherein the turntable is disposed on the same side as the die set, not on the same side as a press main body including a punch drive mechanism that drives the upper and lower punches.

With the above-described feature, the turntable can be handled as part of the die set in a state integrally with the die and the upper and lower punches. Therefore, replacement of the die and axial alignment between the die and the turntable can be performed in the off-line set-up.

Details of Embodiments of Present Disclosure

Details of the embodiments of the present disclosure will be described below with reference to the drawings.

[Sizing Device]

A sizing device 1 according to an embodiment is described below with reference to FIG. 1. The sizing device 1 is a device for performing size correction (also called sizing) of a sintered body (workpiece W) that is carried with the turntable 2. The turntable 2 has a plurality of accommodation holes 21*h* accommodating the workpieces W, and carries the workpiece W in each of the accommodation holes 21*h* to a through hole 31*h* of a die 31 disposed at a workpiece shaping position S one by one, while each of the accommodation holes 21*h* is moved from a workpiece supply position F to a workpiece taking-out position E by the turntable 2 being rotated about a rotation axis Cr. The workpiece W having been carried into the through hole 31*h* of the die 31 is compressed (pressed) for the size correction by upper and lower punches (not illustrated) that are inserted into the through hole 31*h* of the die 31. One of the features of the sizing device 1 resides in including a plurality of identification information holding units 22 (or ID storage media) that correspond to the accommodation holes 21*h* and store tag codes therein, a supply-side input unit 41*w* (or supply-side source) that inputs a tag code to the identification information holding unit 22 corresponding to the accommodation hole 21*h* at the workpiece supply position F when the workpiece W is accommodated into the accommodation hole 21*h* at the workpiece supply position F, and a shaping position input unit 45*w* (or shaping position exchange apparatus) that inputs a new tag code to the identification information holding unit 22 corresponding to the accommodation hole 21*h* at the workpiece shaping position S upon completion of the compression by the upper and lower punches, the new tag code being different from the tag code input by the supply-side input unit 41*w*. First, the workpiece W, namely a sizing target, is described in brief. Thereafter, details of individual components of the sizing device are described with reference to FIG. 1, and control procedures at individual work positions in the sizing device are described with reference to FIGS. 2 to 6 as appropriate. FIG. 1 illustrates an upper surface of the turntable 2 when viewed from a direction of the rotation axis Cr. In other words, the upper punch is disposed on the front side when viewed in a direction perpendicular to a drawing sheet of FIG. 1, and the lower punch is disposed on the rear side when viewed in the direction perpendicular to the drawing sheet of FIG. 1.

[Workpiece]

The workpiece W is typically a metal sintered body that is produced by shaping material powder, which is mainly made of metal powder, into a predetermined shape with a press, and by sintering an obtained powder compact. The metal powder is, for example, iron-based powder or aluminum-based powder. The sintered body may have various shapes in accordance with the shapes of final products, such as a columnar shape and a tubular shape including an axial hole formed at an axial center.

[Turntable]

The turntable 2 has the plurality of accommodation holes 21*h* accommodating the workpieces W, and is rotated about the rotation axis Cr (see FIG. 1). With the rotation of the turntable 2, the workpiece W before the sizing, which has been supplied from the outside and placed into the accommodation hole 21*h* at the workpiece supply position F, is carried from the workpiece supply position F to the die 31 at the workpiece shaping position S. and the workpiece W having been subjected to the sizing in the through hole 31*h* (cavity) of the die 31 is carried from the workpiece shaping position S to the workpiece taking-out position E. The workpiece W in the accommodation hole 21*h*, which has been transferred to the workpiece taking-out position E, is unloaded to the outside of the turntable 2. The turntable 2 has stations (st) corresponding to the number (8 in this embodiment) of the accommodation holes 21*h*. Namely, although described in detail later, the turntable 2 has eight stations 1*st* to 8*st* in this exemplary embodiment. The turntable 2 is a disk-shaped member, and the plurality of identification information holding units 22 corresponding to the accommodation holes 21*h* are disposed near the individual accommodation holes 21*h* in this exemplary embodiment.

(Accommodation Hole)

The accommodation holes 21*h* are holes accommodating the workpieces W. Later-described workpiece holding units (not illustrated) for holding the workpieces W are fitted to the accommodation holes 21*h* in this embodiment. Each of the accommodation holes 21*h* has a circular shape. The diameters of the accommodation holes 21*h* are the same and are greater than the diameter of a maximum circle containing the workpiece W. The number of the accommodation holes 21*h* can be selected as appropriate (e.g., 2 through 12), but in this non-limiting embodiment, the number is 8. The accommodation holes 21*h* are arranged at equal intervals on a circumference that is coaxial with the rotation axis Cr of the turntables 2.

For example, the accommodation holes 21*h* at the workpiece supply position F and the workpiece taking-out position E are located adjacent to each other, and the accommodation hole 21*h* at the workpiece supply position F is located on the forward side of the accommodation hole 21*h* at the workpiece taking-out position E in a rotation direction of the turntable 2. For example, the accommodation hole 21*h* at the workpiece supply position F or the workpiece taking-out position E is located opposite to the die 31 with the rotation axis Cr of the turntable 2 interposed therebetween. The accommodation hole 21*h* at the workpiece supply position F in this embodiment is located opposite to the die 31 with the rotation axis Cr of the turntable 2 interposed therebetween. In more detail, assuming that a later-described basic rotation angle (450 in this embodiment) is one unit of partial rotation, the workpiece W in the accommodation hole 21*h* at the workpiece supply position F is carried to the die 31 after the turntable 2 is partially rotated four times (rotated through 180 in total) from the workpiece supply position F, and is carried to the workpiece taking-out position E after the turntable 2 is partially rotated three times from the position of the die 31 (namely, after the turntable 2 is partially rotated seven times (rotated through 315° in total) from the workpiece supply position F). The accommodation hole 21*h* at the workpiece taking-out position E is moved to the workpiece supply position F after the turntable 2 is partially rotated once from the workpiece taking-out position E (namely, after the turntable 2 is partially rotated eight times (rotated through 360° in total) from the workpiece supply position F).

For example, the workpiece holding unit (or workpiece holder) has an insertion hole having a shape in accordance with an outer shape of the workpiece W and includes an indenter (for example, a ball plunger) that is projected into an inner space of the insertion hole from an inner peripheral surface of the insertion hole to hold the workpiece W. The workpiece holding unit can be constituted by utilizing a workpiece holding unit with a known structure (see PTL 1, the entire contents of which being incorporated herein by reference). By constituting the workpiece holding unit to be removably attached to each accommodation hole, the single turntable 2 can be used in common to the workpieces W having various shapes.

[Identification Information Holding Unit]

The identification information holding unit 22 stores a tag code. The number of the identification information holding units 22 is the same as that of the accommodation holes 21*h* and is eight in this embodiment. The identification information holding units 22 in this embodiment are disposed on the turntable 2 near the individual accommodation holes 21*h*, but they may be disposed in, instead of on the turntable 2, a storage unit in an information processing unit 6 of a computer (e.g., a memory like that discussed in FIG. 7). that is installed in, for example, a press main body (described later). Alternatively, if the identification information holding units 22 are electromagnetically (electrostatically, or even optically) connected to a die set 3 or the press main body, they may be disposed in a storage unit in an information processing unit of a computer that is mechanically independent of the die set 3 or the press main body. Moreover, the identification information holding units 22 may be non-volatile memories that hold data therein, which are then retrievable and exchangeable via near-field communications (NFC) active/passive radiators, Bluetooth, or the like. In this embodiment, the identification information holding units 22 are each arranged at a position in an outer peripheral edge of the turntable 2 between adjacent two of the accommodation holes 21*h*. The identification information holding unit 22 corresponding to each accommodation hole 21*h* is positioned on the backward side of the relevant accommodation hole 21*h* in the rotation direction. The identification information holding units 22 may be arranged at positions on the turntable along an inner peripheral edge (see rectangles denoted by two-dot-chain lines in FIG. 1).

When the identification information holding unit 22 is disposed on the turntable 2, it is, for example, an IC tag that can write, overwrite (update), and read tag codes in a contactless manner (via wireless communication, such as NFC, as discussed above). The type of the tag codes is not limited to particular one insofar as the tag codes enable the identification information holding units 22 to be discriminated individually. The tag codes may be, for example, numerals and/or alphabetic characters (alphanumeric characters). When the tag codes are numerals or alphabetic characters, it is easier to recognize the order in which the tag codes have been assigned to the identification information holding units 22.

The turntable 2 is rotated by a table drive mechanism (e.g., table drivers such as a motor-driven shaft, not illustrated), and the rotation direction of the turntable 2 may be either clockwise or counterclockwise. In this embodiment, the rotation direction is counterclockwise as denoted by an outlined arrow near the hub. The turntable 2 in this embodiment includes a connection base 25 that is connected to the table drive mechanism. The connection base 25 is disposed coaxially with the rotation axis Cr of the turntable 2. The basic rotation angle (i.e., a discrete angular increment) of the turntable 2 can be selected as appropriate depending on the number and the layout of the accommodation holes 21*h*. The basic rotation angle stands for a central angle formed by the centers of the accommodation holes 21*h* adjacent to each other and the center of the turntable 2, and is expressed by "360°/(number of the accommodation holes 21*h*)". In this embodiment, because the eight accommodation holes 21*h* are arranged at equal intervals, the basic rotation angle of the turntable 2 is 45°. In other words, the turntable 2 is rotated counterclockwise in incremental angular steps of 45°. Each time the turntable 2 rotates through 45°, it is stopped temporarily. The rotation, the temporary stop, and the complete stop of the turntable 2 are controlled by a rotation control unit 60 (or rotation controller) described later.

Various types of rotation actuators utilized to rotate an index table can be optionally used as the table drive mechanism. The table drive mechanism in this embodiment includes an index device (commercially available, not illustrated) equipped with a roller gear cam mechanism. Alternatively, an index device equipped with a parallel cam mechanism may be used, or a servo motor may be used instead of the index device. The roller gear cam mechanism in this embodiment is constituted such that, while a driving gear on the primary side rotates through 360°, a driven gear on the secondary side rotates through 45°. A rotation center of the driven gear is arranged coaxially with the rotation axis Cr of the turntable 2. An index-device driving power source (not illustrated, such as a motor for rotating the driving gear in this embodiment) is disposed in the press main body described later.

The carrying of the workpiece W from the outside of the turntable 2 to the accommodation hole 21*h* at the workpiece supply position F can be performed, for example, by grasping the workpiece W with a manipulator such as a robot hand (although not illustrated). As an alternative, the workpiece W may be carried by attracting the workpiece W with an electromagnet or a vacuum pad, for example. In one example, a supply carrying path (not illustrated) is in the form of, for example, a belt conveyer operated to travel and carry the workpiece W is disposed near the workpiece supply position F on the outer side. Such an arrangement enables the workpieces W to be supplied successively.

The carrying of the workpiece W from the accommodation hole 21*h* at the workpiece shaping position S to the die 31 can be performed by dropping the workpiece W from the accommodation hole 21*h* at the workpiece shaping position S into the cavity that is defined by the die 31 and the lower punch (not illustrated). The drop of the workpiece W can be performed, for example, by pressing the workpiece W with the upper punch. Alternatively, the workpiece W may be dropped under its own weight without disposing, for example, the indenter (ball plunger) in the workpiece holding unit. The workpiece W after being subjected to the sizing is pushed up by the lower punch to be withdrawn out of the die 31 and is accommodated into the accommodation hole 21*h* at the workpiece shaping position S again.

The unloading of the workpiece W from the accommodation hole 21*h* at the workpiece taking-out position E to the outside of the turntable 2 can be performed (although not illustrated) by grasping the workpiece W with a manipulator such as a robot hand. Alternatively, the workpiece W may be unloaded (although not illustrated) by dropping the workpiece W from the accommodation hole 21*h* downward, or by attracting the workpiece W from above the accommodation hole 21*h*. In the case of releasing the workpiece W, an unloading carrying path in the form of, for example, a belt conveyer operated to travel and carry the workpiece W is disposed under the accommodation hole 21*h* at the workpiece taking-out position E. Furthermore, the workpiece W can be smoothly unloaded from the accommodation hole 21*h* by disposing, for example, a slide (not illustrated) over which the workpiece W slides down toward the belt conveyor from the accommodation hole 21*h*. In addition, a pressing device (not illustrated) for pressing the workpiece W from above may be separately disposed for the purpose of enabling the workpiece W to drop more easily.

The turntable 2 may be disposed on the same side as the die set 3 including the die 31 and the upper and lower punches, or on the same side as the press main body (not illustrated) including a punch drive mechanism 100 (punch driver) that drives the upper and lower punches. In FIG. 1, for convenience of explanation, the punch drive mechanism 100 is illustrated in the simplified form and denoted by a two-dot-chain line. When the turntable 2 is disposed on the same side as the die set 3 instead of on the press main body side, the turntable 2 can be handled as part of the die set 3 in a state integrally with the die 31 and the upper and lower punches. It is hence possible in the off-line set-up to attach the workpiece holding unit to the turntable 2 that has been mount to the die set 3, and to adjust (exchange) an indenter (such as a ball plunger) for holding the workpiece W. Various types of mechanisms capable of reciprocating the upper and lower punches can be optionally utilized as the punch drive mechanism 100. For example, a hydraulic ram cylinder can be utilized. The press main body includes a power source (not illustrated), such as a motor, for operating a pump to flow a hydraulic operating fluid in the hydraulic ram cylinder.

The turntable 2 in this embodiment is removably mounted to the die set 3. Accordingly, the turntable 2 can be handled as part of an assembly (die set 3) in a state integrally with the die 31 and the upper and lower punches. Hence the turntable 2 can be mounted to the die set 3 (for exchange) in the off-line set-up. In more detail, the die set 3 includes, in addition to the die 31 and the upper and lower punches, a die plate 35 for holding the die. The turntable 2 is mounted to an upper side of the die plate 35. The die plate 35 includes a semicircular portion supporting substantially a half of a lower surface of the turntable 2 and having a peripheral edge that follows a circumferential edge of the turntable 2, and a rectangular portion supporting the remaining half of the turntable 2 and being larger than the turntable 2. A region where the die 31 is arranged is located in the rectangular portion. In the region where the die 31 is arranged, a punch insertion hole (not illustrated) vertically penetrating the die plate is formed such that the upper punch and the lower punch can be inserted to the through hole 31*h* of the die 31.

[Summary of Various Positions]

In the sizing device 1, as described above, with the counterclockwise rotation of the turntable 2, the accommodation hole 21*h* is moved from the workpiece supply position F to the workpiece taking-out position E. In this embodiment, assuming that the workpiece supply position F is denoted by 1*st* (station) and subsequent positions corresponding to the accommodation holes 21*h* are denoted by 2*st* to 8*st* in sequence in the counterclockwise direction, the workpiece shaping position S is 5*st*, the workpiece taking-out position E is 8*st*, a later-described workpiece pre-shaping position B is 3*st*, and a later-described workpiece post-shaping position A is 6*st*. The supply-side input unit 41*w* (supply-side source) and the supply-side read unit 41*r*

(supply-side reader) are disposed at the workpiece supply position F. A pre-shaping read unit 43*r* (pre-shaping reader) and a propriety detection unit 53 (propriety detector, or detector) are disposed at the workpiece pre-shaping position B. A shaping position read unit 45*r* (shaping position reader), a shaping position input unit 45*w* (shaping position source), and a pressure measurement unit 55 (pressure sensor) are disposed at the workpiece shaping position S. A post-shaping read unit 46*r* (post-shaping reader), a post-shaping input unit 46*w* (post-shaping source), and a presence detection unit 56 (presence sensor) are disposed at the workpiece post-shaping position A. A taking-out-side read unit 48*r* (taking-out-side reader) and a taking-out-side input unit 48*w* (taking-out-side source) are disposed at the workpiece taking-out position E.

[Workpiece Supply Position]

(Supply-Side Input Unit)

The supply-side input unit 41*w* inputs a tag code to the identification information holding unit 22 corresponding to the accommodation hole 21*h* at the workpiece supply position F (1*st*). The timing of inputting the tag code by the supply-side input unit 41*w* is, for example, the time when the workpiece W is accommodated into the accommodation hole 21*h* at the workpiece supply position F. More specifically, the timing of inputting the tag code is, for example, the time of receiving a control signal that is output from a robot hand control unit (not illustrated) when the workpiece W is accommodated into the accommodation hole 21*h* by the robot hand under control of the robot hand control unit.

The tag code input by the supply-side input unit 41*w* includes, for example, the accommodation date of the workpiece W, the number of the accommodated workpiece W, and a numeral or an alphabet preset as a symbol implying that the workpiece W has been accommodated. The number of the workpiece W is, for example, one of numerals consecutive from 1. The symbol implying that the workpiece W has been accommodated is given by a numeral "1" in this embodiment. Of the tag code input by the supply-side input unit 41*w*, the symbol implying that the workpiece W has been accommodated may be held together with a tag code that has been input to the identification information holding unit 22 by the taking-out-side input unit 48*w*, described later, at the workpiece taking-out position E (8*st*), or may be input so as to overwrite and update the tag code in the identification information holding unit 22. Of the tag code input by the supply-side input unit 41*w*, the accommodation date of the workpiece W and the number of the accommodated workpiece W are overwritten. Thus, even when the accommodation date of the workpiece W and the number of the accommodated workpiece W each having been previously input remain in the identification information holding unit 22 that has passed the workpiece taking-out position E, they are updated. Accordingly, the correct accommodation date of the workpiece W and the correct number of the accommodated workpiece W can be grasped. The tag code input by the supply-side input unit 41*w* is read by the pre-shaping read unit 43*r* and the shaping position read unit 45*r* both described later, and is used in a later-described propriety detection control unit 63 (propriety detection controller) that controls the operation of the propriety detection unit 53, a punch control unit 65 that controls the punch drive mechanism 100, and so on.

In this embodiment, the supply-side input unit 41*w* is arranged at a position outside the turntable 2. This point is similarly applied to the other input units and the other read units. The type of the supply-side input unit 41*w* is selected for example, in accordance with the type of the identification information holding unit 22. While the supply-side input unit 41*w* is constituted in this embodiment by using an IC tag reader/writer of contactless (wireless communication) type having the function (read function) of the below-described supply-side read unit 41*r* as well, an IC tag writer not having the function of the supply-side read unit 41*r* may be used instead. When the identification information holding unit 22 is arranged on the turntable 2 at a position on the inner peripheral side of the turntable 2, the supply-side input unit 41*w* and the other later-described input units 45*w*, 46*w* and 48*w*, and the later-described read units 41*r*, 43*r*, 45*r*, 46*r* and 48*r* may be arranged at positions on the inner side of the turntable 2.

(Supply-Side Read Unit)

The supply-side read unit 41*r* reads a tag code held in the identification information holding unit 22 corresponding to the accommodation hole 21*h* at the workpiece supply position F (1*st*). The timing of reading the tag code by the supply-side read unit 41*r* is, for example, the time when the turntable 2 is partially rotated once and is temporarily stopped. The point that the read timing is the time when the turntable 2 is temporarily stopped is similarly applied to the pre-shaping read unit 43*r*, the shaping position read unit 45*r*, the post-shaping read unit 46*r*, and the taking-out-side read unit 48*r* all of which are described later. The tag code read by the supply-side read unit 41*r* is utilized in the robot hand control unit (robot controller, or control circuitry) that drives the robot hand, and in the rotation control unit 60 (rotation controller). While, as described above, the IC tag reader/writer including the function of the supply-side input unit 41*w* is used as the supply-side read unit 41*r* in this embodiment, an IC tag reader not having the function of the supply-side input unit 41*w* may be used instead.

[Workpiece Pre-Shaping Position]

(Pre-Shaping Read Unit)

The pre-shaping read unit 43*r* reads a tag code held in the identification information holding unit 22 corresponding to the accommodation hole 21*h* at the workpiece pre-shaping position B (3*st*). The workpiece pre-shaping position B is located downstream of the workpiece supply position F (1*st*) and upstream of the workpiece shaping position S (5*st*), and it is positioned, as described above, at 3*st* in this embodiment. However, the workpiece pre-shaping position B may be positioned at 2*st* or 4*st*. The tag code read by the pre-shaping read unit 43*r* is utilized in the propriety detection control unit 63 that controls the operation of the propriety detection unit 53 described later. An IC tag reader of contactless (wireless communication) type is used as the pre-shaping read unit 43*r* in this embodiment.

(Propriety Detection Unit)

The propriety detection unit 53 detects, based on a read result by the pre-shaping read unit 43*r*, whether an accommodation state of the workpiece W in the accommodation hole 21*h* corresponding to the identification information holding unit 22 from which the tag code has been read by the pre-shaping read unit 43*r* is proper or not. In FIG. 1, for convenience of explanation, the propriety detection unit 53 is illustrated in the simplified form and denoted by a two-dot-chain line. The detection result of the propriety detection unit 53 is "improper", for example, when the turntable 2 is normally rotated in spite of that the workpiece W is accommodated in the state in which a phase (particular position in the circumferential direction) of the workpiece W is deviated relative to the accommodation hole 21*h* at the workpiece supply position F, that the workpiece W is accommodated in an inclined posture, that the workpiece W is accommodated in an upside-down posture, or that several workpieces Ware accommodated together. By detecting whether the accommodation state of the workpiece W is proper or not, therefore, it is possible to prevent the workpiece W in the improper accommodation state from being carried to the workpiece shaping position S, and to prevent the workpiece W in the improper accommodation state from being subjected to the sizing. The propriety detection unit 53 can be constituted, for example, by using a jig that is descended from above the accommodation hole 21*h* and is inserted into the accommodation hole 21*h*. A surface of the jig coming into contact with the workpiece W has a shape in accordance with the shape of the workpiece W in the state in which the workpiece W is properly accommodated in the accommodation hole 21*h*. With the jig having such a contact surface, when the accommodation state of the workpiece Win the accommodation hole 21*h* is proper, the jig can be descended down to a predetermined depth. On the other hand, if the accommodation state of the workpiece W in the accommodation hole 21*h* is improper, the jig cannot be descended down to the predetermined depth. Whether the accommodation state of the workpiece W in the accommodation hole 21*h* is proper or not is detected from a difference in depth through which the jig can be descended. The operation of the propriety detection unit 53 is controlled by the propriety detection control unit 63 described later. The detection result of the propriety detection unit 53 is utilized in the rotation control unit 60 described later. The propriety detection unit 53 can detect not only whether the accommodation state of the workpiece W is proper or not, but also the case in which the workpiece W having an improper shape has been accommodated into the accommodation hole 21*h*. If the workpiece W having an improper shape is mixed in the workpieces W carried to the sizing device 1, the improper workpiece W may be accommodated into the accommodation hole 21*h* at the workpiece supply position F.

[Workpiece Shaping Position]

(Shaping Position Read Unit)

The shaping position read unit 45*r* reads a tag code held in the identification information holding unit 22 corresponding to the accommodation hole 21*h* at the workpiece shaping position S (5*st*). The tag code read by the shaping position read unit 45*r* is utilized in the rotation control unit 60 and the punch control unit 65. Like the supply-side input unit 41*w*, the shaping position read unit 45*r* in this embodiment is constituted by using an IC tag reader/writer of contactless (wireless communication) type having the function (input function) of the below-described shaping position input unit 45*w* as well.

(Shaping Position Input Unit)

The shaping position input unit 45*w* inputs a new tag code to the identification information holding unit 22 corresponding to the accommodation hole 21*h* at the workpiece shaping position S upon completion of the pressing by the upper punch. In other words, the timing of inputting the tag code by the shaping position input unit 45*w* is after the completion of the pressing by the upper punch.

The new tag code input by the shaping position input unit 45*w* may be a numeral or an alphabet preset as a symbol implying the completion of the pressing, but it is preferably a tag code in accordance with a value measured by the pressure measurement unit 55 described later. The tag code in accordance with the measured value is, for example, one of numerals or alphabets preset as three symbols implying that the measured value is within a setting range, that the measured value is over an upper limit of the setting range, and that the measured value is below a lower limit of the setting range. In this case, by reading the tag code, it can be determined that a product having been pressed by the upper punch for the sizing is which one of a sizing-pressure proper product that has been pressed under the proper pressure, a sizing-pressure excessive product that has been excessively pressed, and a sizing-pressure insufficient product that has been insufficiently pressed. In this embodiment, a numeral "2" is used as the symbol implying that the measured value is within the setting range, a numeral "3" is used as the symbol implying that the measured value is over the upper limit of the setting range, and a numeral "4" is used as the symbol implying that the measured value is below the lower limit of the setting range. The tag code (one of the numerals "2" to "4") input upon the completion of the pressing may be held together with the tag code (numeral "1") that has been input to the identification information holding unit 22 by the supply-side input unit 41*w* at the workpiece supply position F (1*st*), or may be input so as to overwrite and update the tag code (numeral "1"). On the other hand, the accommodation date of the workpiece W and the number of the accommodated workpiece W having been input to the identification information holding unit 22 by the supply-side input unit 41*w* are maintained without being overwritten by the shaping position input unit 45*w*. This point is similarly applied to the post-shaping input unit 46*w* described later. The tag code (one of the numerals "2" to "4") input upon the completion of the pressing is read by the post-shaping read unit 46*r* and the taking-out-side read unit 48*r* both described later, and is utilized in a later-described presence detection control unit 66 that controls the operation of the presence detection unit 56, the above-described robot hand control unit, and so on, or it is stored in a later-described storage unit 68.

Preferably, at the start of driving of the upper punch, the shaping position input unit 45*w* inputs a new tag to the identification information holding unit 22 corresponding to the accommodation hole 21*h* at the workpiece shaping position S. The new tag code input at the start of driving of the upper punch is, for example, a numeral or an alphabet preset as a symbol implying that the driving of the upper punch has been started. In this embodiment, the new tag code is a numeral "7". Thus, the shaping position input unit 45*w* preferably inputs the new tag code (numeral "7") at the start of driving of the upper punch and then inputs the other new tag (one of the numerals "2" to "4") upon the completion of the pressing. The tag code input as "7" can be utilized to grasp that the workpiece is in the state "not subjected to the sizing". If the upper punch is stopped for some reason without pressing the workpiece (for example, if the detection result of the propriety detection unit 53 is "improper", or if the detection result of the later-described presence detection unit 56 is "absence") after the upper punch has started the driving (namely, after "7" has been input), it is understood that the workpiece W at the workpiece shaping position S is not subjected to the sizing, because the tag code "7" is input. The shaping position input unit 45*w* in this embodiment is constituted, as described above, by using the IC tag reader/writer of contactless (wireless communication) type having the function of the shaping position read unit 45*r* as well.

(Pressure Measurement Unit)

The pressure measurement unit 55 measures the punch pressing force. More specifically, the pressure measurement unit 55 measures the maximum pressing force when the workpiece W is pressed by the upper and lower punches. A value measured by the pressure measurement unit 55 changes depending on the volume of the workpiece W before the sizing. In more detail, when the volume of the workpiece W is within a setting range, the measured value is within a setting range. When the volume of the workpiece W is excessive (over an upper limit of the setting range), the measured value is over an upper limit of the setting range. When the volume of the workpiece W is insufficient (below a lower limit of the setting range), the measured value is below a lower limit of the setting range. The reason is as described below. When the sizing is performed by a mechanical press, a lower limit position of an upper punch is determined from the mechanical point of view. When the sizing is performed by a hydraulic press, a punch position control technique is adopted and a lower limit position of an upper punch is also determined. In other words, regardless of the type of the press used in the sizing, the lower limit position of the upper punch is usually determined. Accordingly, if the volume of the workpiece W is excessive, the sizing-pressure excessive product is produced, and if the volume of the workpiece W is insufficient, the sizing-pressure insufficient product is produced. A result measured by the pressure measurement unit 55 is utilized in the above-described shaping position input unit 45*w*. A pressure gauge attached to the punch drive mechanism 100 can be used as the pressure measurement unit 55.

[Workpiece Post-Shaping Position]

(Post-Shaping Read Unit)

The post-shaping read unit 46*r* reads a tag code held in the identification information holding unit 22 corresponding to the accommodation hole 21*h* at the workpiece post-shaping position A (6*st*). The workpiece post-shaping position A is located downstream of the workpiece shaping position S (5*st*) and upstream of the workpiece taking-out position E (8*st*), and is located at the station (6*st*) one downstream from the workpiece shaping position S. Note that the workpiece post-shaping position A is not to be located at the station (7*st*), namely the station two or more downstream from the workpiece shaping position S. This is because, if so, it would be impossible to prevent the next workpiece W from being pressed by the upper punch in the state in which the preceding workpiece W remains sticking to the upper punch. The tag code read by the post-shaping read unit 46*r* is utilized in the rotation control unit 60 and the later-described presence detection control unit 66. Like the supply-side input unit 41*w* and so on, the post-shaping read unit 46*r* in this embodiment is constituted by using an IC tag reader/writer of contactless (wireless communication) type having the function of the below-described post-shaping input unit 46*w* as well.

(Post-Shaping Input Unit)

The post-shaping input unit 46*w* inputs, in accordance with the detection result of the later-described presence detection unit 56, a new tag code to the identification information holding unit 22 corresponding to the accommodation hole 21*h* (namely, the accommodation hole 21*h* that has been subjected to the detection by the presence detection unit 56) at the workpiece post-shaping position A. In other words, the timing of inputting the tag code by the post-shaping input unit 46*w* is the time when the detection result of the presence detection unit 56 is issued. The new tag code input by the post-shaping input unit 46*w* is, for example, a numeral or an alphabet preset as a symbol implying that the workpiece W is absent in the accommodation hole 21*h*. In this embodiment, the new tag code is a numeral "5". In accordance with the new code, it is possible to grasp that the workpiece W after the sizing is in the state still sticking to the upper punch. The tag code (numeral "5") may be held together with the tag code (one of the numerals "2" to "4") that has been input to the identification information holding unit 22 by the shaping position input unit 45*w* at the workpiece shaping position S (5*st*), or may be input so as to overwrite and update the latter tag code. The post-shaping input unit 46*w* in this embodiment is constituted, as described above, by using the IC tag reader/writer of contactless (wireless communication) type having the function of the later-described post-shaping read unit 46*r* as well.

(Presence Detection Unit)

The presence detection unit 56 detects, based on a read result of the post-shaping read unit 46*r*, the presence or the absence of the workpiece W in the accommodation hole 21*h* corresponding to the identification information holding unit 22 from which the tag code has been read by the post-shaping read unit 46*r*. In FIG. 1, for convenience of explanation, the presence detection unit 56 is illustrated in the simplified form and denoted by a two-dot-chain line. The detection result of the presence detection unit 56 is "absence" when the turntable 2 is normally rotated while the workpiece W remains sticking to the upper punch. By detecting the presence or the absence of the workpiece W, therefore, it is possible to determine whether the workpiece W remains sticking to the upper punch, and to prevent the next workpiece W from being pressed by the upper punch in the state in which the preceding workpiece W remains sticking to the upper punch. For example, the presence detection unit 56 can be constituted by using a jig that is descended from above the accommodation hole 21*h* and is inserted into the accommodation hole 21*h*. A depth through which the jig can be descended changes depending on the presence or the absence of the workpiece W. More specifically, when the workpiece W is absent, the depth through which the jig can be descended is deeper than when the workpiece is present. The presence or the absence of the workpiece Win the accommodation hole 21*h* is detected from a difference in depth through which the jig can be descended. The operation of the presence detection unit 56 is controlled by the presence detection control unit 66 described later. A laser range finder may be used as the presence detection unit 56. In such a case, the presence or the absence of the workpiece W may be detected from a difference in the measured distance, the difference being caused by the presence or the absence of the workpiece W

[Workpiece Taking-Out Position]

(Taking-Out-Side Read Unit)

The taking-out-side read unit 48*r* reads the tag code that has been input to the identification information holding unit 22 corresponding to the accommodation hole 21*h* at the workpiece taking-out position E (8*st*). The tag code read by the taking-out-side read unit 48*r* is utilized in the rotation control unit 60 and the above-described robot hand control unit, or it is stored in the later-described storage unit 68 and utilized to sort the workpieces W (products after the sizing) that have been taken out from the accommodation hole 21*h*. Like the supply-side input unit 41*w* and soon, the staking-out-side read unit 48*r* in this embodiment is constituted by using an IC tag reader/writer of contactless (wireless communication) type having the function of the below-described taking-out-side input unit 48*w* as well.

(Taking-Out-Side Input Unit)

The taking-out-side input unit 48*w* inputs a new tag code to the identification information holding unit 22 corresponding to the accommodation hole 21*h* at the workpiece taking-out position E (8*st*). The timing of inputting the tag code by the taking-out-side input unit 48*w* is, for example, the time when the workpiece W is taken out from the accommodation hole 21*h* at the workpiece taking-out position E. More specifically, the timing of inputting the tag code is, for example, the time of receiving a control signal output from the robot hand control unit when the workpiece W is taken out from the accommodation hole 21*h* by the robot hand. The new tag code input by taking-out-side input unit 48*w* is, for example, a numeral or an alphabet (numeral "0" in this embodiment) preset as a symbol implying that the workpiece W has been taken out. The new tag code is not to be held together with the tag code that has been input to the identification information holding unit 22 before, and it is input so as to overwrite and update the previous tag code. The taking-out-side input unit 48*w* in this embodiment is constituted, as described above, by using the IC tag reader/writer of contactless (wireless communication) type having the function of the above-described taking-out-side read unit 48*r* as well.

[Information Processing Unit]

The information processing unit 6 includes the rotation control unit 60, the propriety detection control unit 63, a propriety determination unit 631 (propriety determination detector), the punch control unit 65, the presence detection control unit 66, a presence determination unit 661, and the storage unit 68. A computer equipped with a processor, such as that described in FIG. 7, executing later-described control procedures can be used as the information processing unit 6. The computer may be disposed in the press main body, for example, or may be disposed mechanically independently of the die set 3 and the press main body insofar as the computer is electromagnetically connected to the die set 3 and the press main body.

(Rotation Control Unit)

The rotation control unit 60 issues a command to the table drive mechanism to partially rotate, temporarily stop, or completely stop the turntable 2. The command is issued in accordance with not only the tag codes read by the supply-side read unit 41*r*, the shaping position read unit 45*r*, the post-shaping read unit 46*r*, and the taking-out-side read unit 48*r*, but also the detection results of the propriety detection unit 53 and a later-described abnormality detection unit (not illustrated).

(Propriety Detection Control Unit and Propriety Determination Unit)

The propriety detection control unit 63 issues a command to control the operation and the stop of the propriety detection unit 53. The command is issued in accordance with the tag code read by the pre-shaping read unit 43*r*. The propriety determination unit 631 determines, based on the detection result of the propriety detection unit 53, whether the accommodation state of the workpiece W in the accommodation hole 21*h* is proper or not. The determination regarding the propriety of the accommodation state of the workpiece W can be performed in accordance with the depth through which the propriety detection unit 53 can be descended. In a practical example, if the depth through which the propriety detection unit 53 can be descended is deep, it is determined that the accommodation state of the workpiece W is proper, and if the depth through which the propriety detection unit 53 can be descended is shallow, it is determined that the accommodation state of the workpiece W is improper.

[Punch Control Unit]

The punch control unit 65 (punch controller) issues a command to the punch drive mechanism 100 to control the driving and the stop of the upper and lower punches. The command is issued in accordance with the tag code read by the shaping position read unit 45*r*.

(Presence Detection Control Unit and Presence Determination Unit)

The presence detection control unit 66 (punch detection controller) issues a command to control the operation and the stop of the presence detection unit 56. The command is issued in accordance with the tag code read by the post-shaping read unit 46*r*. The presence determination unit 661 (presence detector) determines, based on the detection result of the presence detection unit 56, whether the workpiece W is present or absent. The determination regarding the presence or the absence of the workpiece W can be performed in accordance with the depth through which the presence detection unit 56 can be descended. In a practical example, if the depth through which the presence detection unit 56 can be descended is shallow, it is determined that the workpiece W is accommodated in the accommodation hole 21*h*, and if the depth through which the presence detection unit 56 can be descended is deep, it is determined that the workpiece W is not accommodated in the accommodation hole 21*h*.

[Storage Unit]

The storage unit 68 stores the tag code read by the taking-out-side read unit 48*r*. This enables the history of the product after the sizing to be grasped from the tag code corresponding to each workpiece. More specifically, the following points can be grasped; namely, when and in what number the product after the sizing has been loaded as the workpiece W into the sizing device 1, and the product after the sizing is which one of the sizing-pressure proper product, the sizing-pressure excessive product, the sizing-pressure insufficient product, and the product still sticking to the upper punch even after the sizing. When the plurality of identification information holding units 22 are disposed in the information processing unit 6 equipped in the press main body, the storage unit 68 stores the tag codes that have been input to the individual identification information holding units 22.

[Others]

Preferably, the sizing device 1 further includes the abnormality detection unit (not illustrated) that detects an abnormality in rotation of the turntable 2. The abnormality detection unit detects the abnormality by using a torque measurement unit that measures rotation torque of the turntable 2, and a torque determination unit that determines whether a value measured by the torque measurement unit is over an upper limit of a setting range or not. A torque gauge attached to the table drive mechanism can be used as the torque measurement unit. The information processing unit 6 can be used as the torque determination unit. The measured value of the torque exceeds the upper limit value of the setting range upon the occurrence of a trouble such as biting of a foreign matter or the like into the table drive mechanism. Accordingly, the abnormality in rotation of the turntable 2 can be detected by determining, in the torque determination unit, whether the measured value of the torque is over the upper limit value of the setting range or not. For example, a torque limiter can be suitably used as the torque determination unit. Because a spring in the torque limiter is contracted when the measured torque is over the upper limit value of the setting range, whether the measured torque is over the upper limit value of the setting range or not can be determined by detecting expansion and contraction of the spring. The determination result of the torque determination unit is utilized in the rotation control unit 60. More specifically, upon the occurrence of any abnormality in the turntable 2, the rotation control unit 60 commands the table drive mechanism to completely stop the rotation of the turntable 2. In such a case, preferably, a numeral or an alphabet (numeral "8" in this embodiment) is input, as a symbol implying the occurrence of the abnormality in the turntable, to the identification information holding unit 22 by at least one of the input units 41*w*, 45*w*, 46*w* and 48*w*. In this embodiment, the numeral "8" is input to the identification information holding unit 22 by each of the shaping position input unit 45*w* and the post-shaping input unit 46*w*.

Preferably, the sizing device 1 further includes at least one of a display device, such as a monitor, an illumination device such as an alarm lamp, and a warning device such as a warning speaker. An operator can visually check, for example, the tag code held in each identification information holding unit 22 using the display device. The illumination device emits light and the warning device emits sound in accordance with the detection result of the propriety detection unit 53 or the detection result of the presence detection unit 56 in order to notify the operator of the event that the turntable 2 has stopped or that any abnormality has occurred in the turntable 2. The above-mentioned devices are disposed in the press main unit, for example.

[Control Procedures]

Control procedures performed at the workpiece supply position F, the workpiece pre-shaping position B, the workpiece shaping position S, the workpiece post-shaping position A, and the workpiece taking-out position E in the sizing device 1 will be described below with reference to flowcharts of FIGS. 2 to 6 (while referring to FIG. 1 as appropriate). The control procedures are processed in parallel, and may be performed with the circuitry described in FIG. 7. Only when a partial-rotation command is issued in all the control procedures, the turntable 2 is partially rotated once to continue the operation of the sizing device 1. When a stop command is issued in any one of all the control procedures, the entirety of the sizing device 1, including the turntable 2 and the upper punch, is completely stopped. In FIGS. 2 to 6, for convenience of explanation, only the stop commands for the turntable 2 and the upper punch are illustrated, and the stop commands for the other components of the sizing device 1 are omitted. Here, numerals "0" to "5", "7" and "8" are preset as the tag codes. The meanings of the numerals are given below. Prior to the startup of the sizing device 1, for example, the turntable 2 is idly rotated and "0" is input to all the identification information holding units 22 at the taking-out-side input unit 48*w*. When the plurality of identification information holding units 22 are disposed, for example, in the storage unit of the information processing unit 6 equipped in the press main body instead of being disposed on the turntable 2, "0" can be input to the identification information holding unit 22 corresponding to each accommodation hole 21*h* without idly rotating the turntable 2.

"0": Absence of the workpiece in the accommodation hole 21*h*

"1": Presence of the workpiece in the accommodation hole 21*h*

"2": Measured value of the punch pressing force is within the setting range

"3": Measured value of the punch pressing force is over the upper limit of the setting range "4": Measured value of the punch pressing force is below the lower limit of the setting range "5": Workpiece W remains sticking to the upper punch "7": Start of punch driving "8": Occurrence of abnormality in the turntable 2

Figure 2:
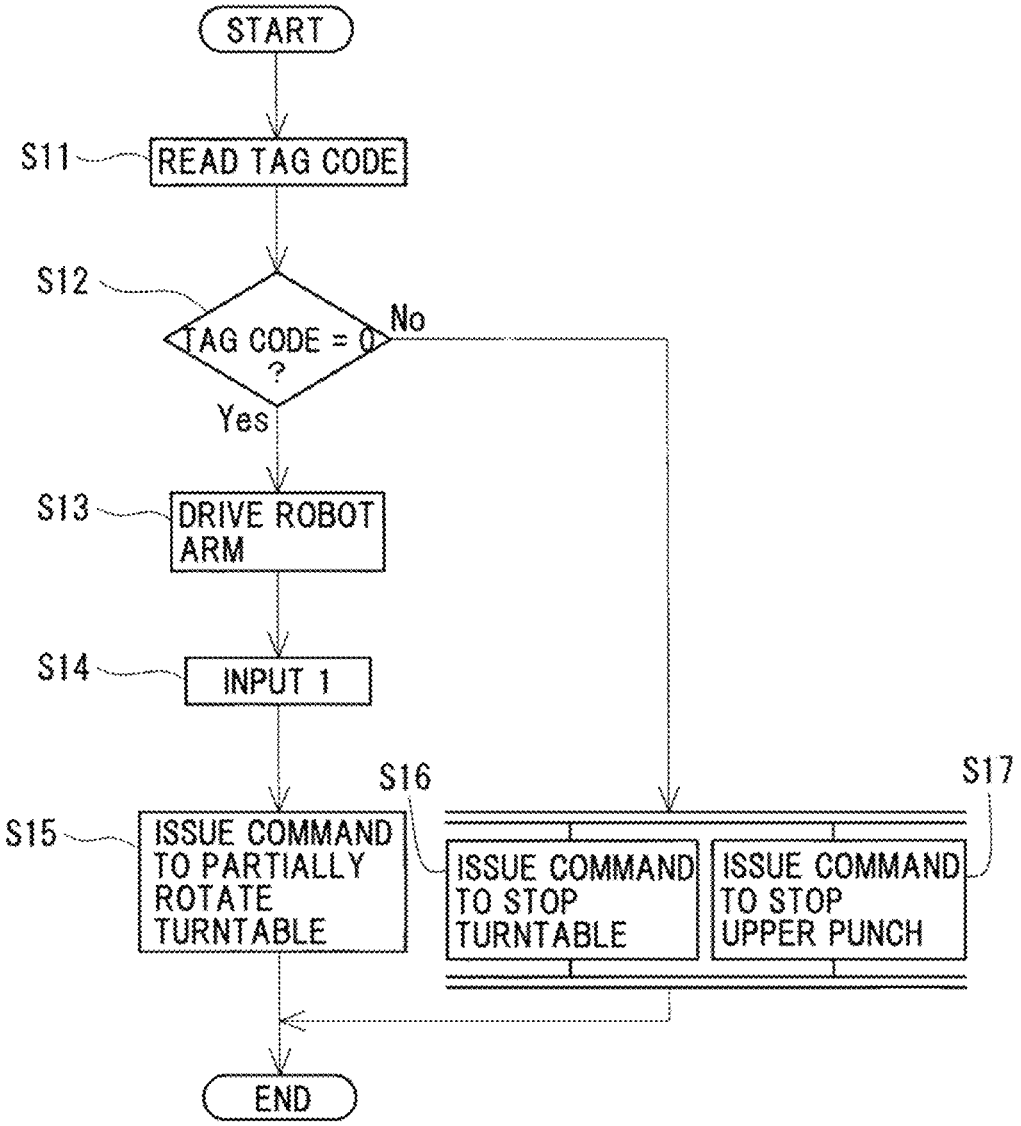
FIG. 2 is a flowchart illustrating a control procedure at a workpiece supply position in the sizing device according to the exemplary embodiment.

(Control Procedure at Workpiece Supply Position: FIG. 2)

The supply-side read unit 41*r* reads the tag code held in the identification information holding unit 22 (step S11). The information processing unit 6 determines whether the tag code read in step S11 is "0" or not (step S12).

If the determination result in step S12 is "Yes", the robot hand control unit drives the robot hand to accommodate the workpiece W into the accommodation hole 21*h* (step S13). Then, upon receiving a signal sent from the robot hand, the supply-side input unit 41*w* inputs the accommodation date of the workpiece W, the number (one of numerals consecutive from 1) of the accommodated workpiece W, and "1" to the identification information holding unit 22 (step S14). Then, the rotation control unit 60 issues a command to the table drive mechanism to partially rotate the turntable 2 once (step S15). The control in this case is then ended.

If the determination result in step S12 is "No", the rotation control unit 60 issues a command to the table drive mechanism to completely stop the turntable 2 (step S16). Then, the punch control unit 65 issues a command to the punch drive mechanism 100 to stop the upper punch (step S17). Step S16 and step S17 are out of order and those steps may be executed at the same time. The control in this case is then ended. The reason why the determination result in step S12 is "No" resides in that the turntable 2 has been manually moved to an improper position by mistake after it stopped due to malfunction. In other words, the reason resides in that the turntable has been manually moved in a false direction. After the complete stop of the turntable 2, the turntable 2 is manually moved in a direction opposite to the direction of the previous manual operation, and the sizing device 1 is restarted.

Figure 3:
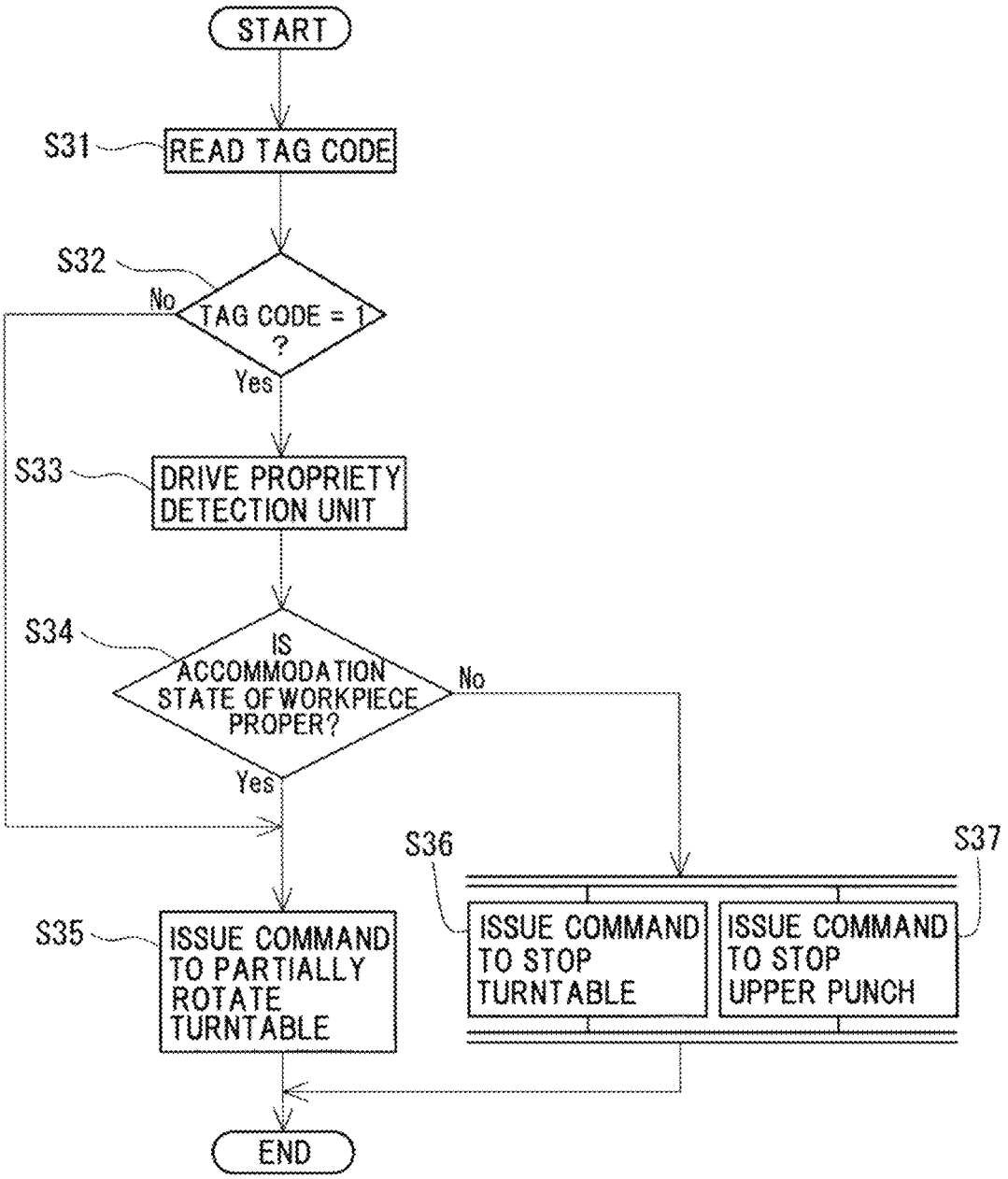
FIG. 3 is a flowchart illustrating a control procedure at a workpiece pre-shaping position in the sizing device according to the exemplary embodiment.

(Control Procedure at Workpiece Pre-Shaping Position: FIG. 3)

The pre-shaping read unit 43*r* reads the tag code held in the identification information holding unit 22 (step S31). The information processing unit 6 determines whether the tag code read in step S31 is "1" or not (step S32).

If the determination result in step S32 is "Yes", the propriety detection unit 53 is driven by the propriety detection control unit 63 to detect the accommodation state of the workpiece W in the accommodation hole 21*h* (step S33). The propriety determination unit 631 determines, based on the detection result, whether the accommodation state of the workpiece W in the accommodation hole 21*h* is proper or not (step S34).

If the determination result in step S34 is "Yes (proper)", the rotation control unit 60 issues a command to the table drive mechanism to partially rotate the turntable 2 once (step S35). The control in this case is then ended.

If the determination result in step S32 is "No", the control in this case is ended after executing step S35. The reason is as described below. In this embodiment, if the determination result in step S32 is "No", the tag code read in step S31 is substantially "0". Thus, even when the turntable 2 is manually moved to an improper position by mistake under condition the workpiece pre-shaping position B is located at 3*st* and the turntable 2 is stopped due to malfunction, the turntable 2 is in no way partially rotated twice or more.

If the determination result in step S34 is "No (improper)", the rotation control unit 60 issues a command to the table drive mechanism to completely stop the turntable 2 (step S36). Then, the punch control unit 65 issues a command to the punch drive mechanism 100 to stop the upper punch (step S37). Step S36 and step S37 are out of order and those steps may be executed at the same time. The control in this case is then ended. The determination result in step S34 is "No (improper)", for example, when the turntable 2 is normally rotated in spite of that the workpiece W is accommodated in the state in which the phase of the workpiece W is deviated relative to the accommodation hole 21*h* at the workpiece supply position F, that the workpiece W is accommodated in an inclined posture, that the workpiece W is accommodated in an upside-down posture, that several workpieces W are accommodated together, or that the workpiece W having an improper shape is accommodated. Accordingly, the above control can make it possible to prevent the carrying of the workpiece W in the improper accommodation state to the workpiece shaping position S, and to prevent the sizing of the workpiece W in the improper accommodation state. This is because the workpiece W in the improper accommodation state can be detected and the turntable 2 can be stopped before the relevant workpiece W is carried to the workpiece shaping position S. After the complete stop of the turntable 2, the improper workpiece in the accommodation hole 21*h* at 3*st* is manually taken out, a new workpiece is accommodated into the accommodation hole 21*h*, and the sizing device 1 is restarted.

Figure 4:
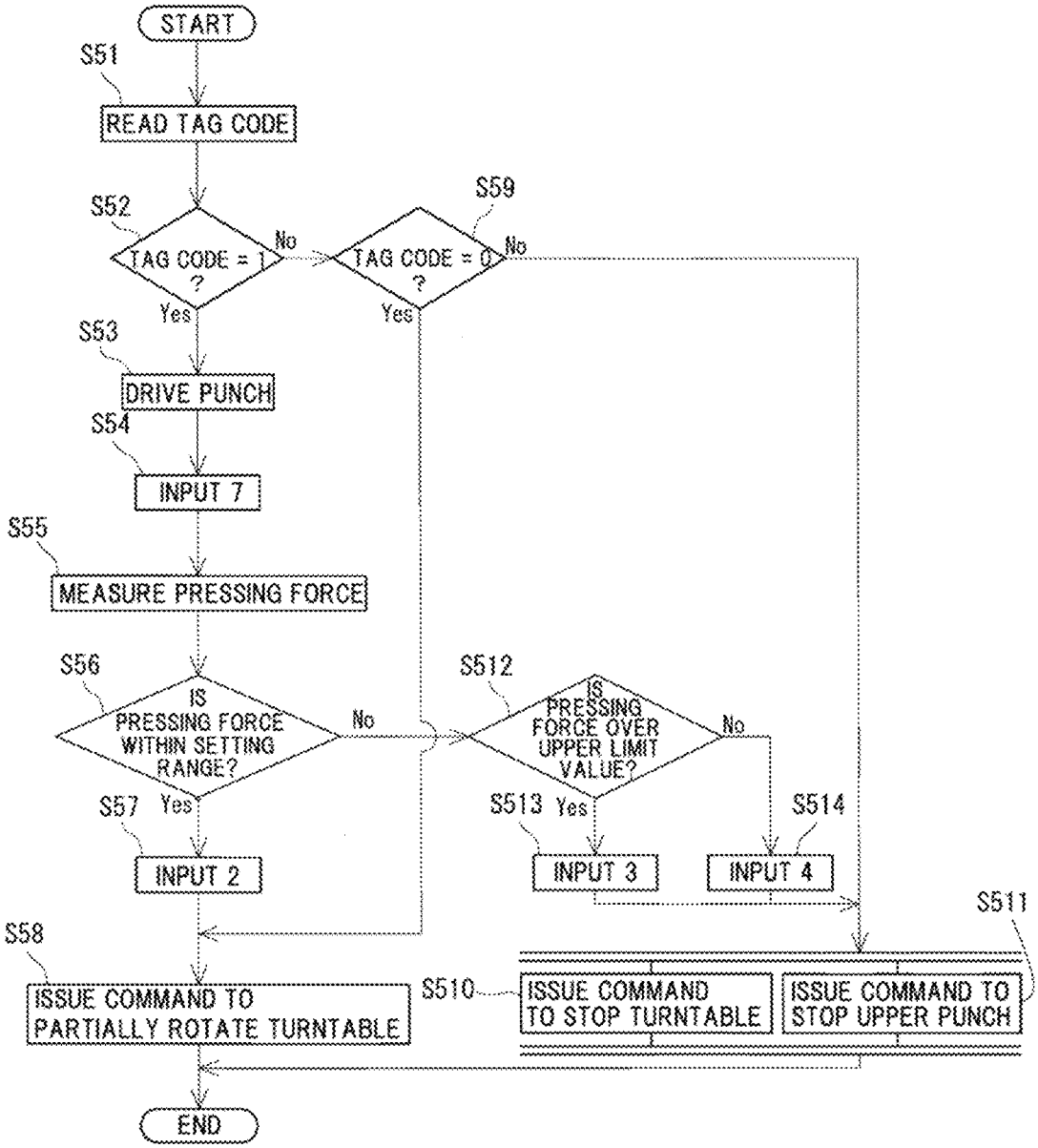
FIG. 4 is a flowchart illustrating a control procedure at a workpiece shaping position in the sizing device according to the exemplary embodiment.

(Control Procedure at Workpiece Shaping Position: FIG. 4)

The shaping position read unit 45*r* reads the tag code held in the identification information holding unit 22 (step S51). The information processing unit 6 determines whether the tag code read in step S51 is "1" or not (step S52).

If the determination result in step S52 is "Yes", the punch control unit 65 drives the punch drive mechanism 100 to press the workpiece W in the accommodation hole 21*h* by the upper and lower punches (step S53). At the time of starting the driving of the upper and lower punches, the shaping position input unit 45*w* inputs "7" to the identification information holding unit 22 (step S54). The pressure measurement unit 55 measures maximum pressing force when the workpiece W is pressed by the upper and lower punches (step S55). Then, whether a value measured in step S55 is within the setting range or not is determined (step S56).

If the condition in step S56 is satisfied, the shaping position input unit 45*w* inputs "2" to the identification information holding unit 22 (step S57). Then, the rotation control unit 60 issues a command to the table drive mechanism to partially rotate the turntable 2 once (step S58). The control in this case is then ended.

If the determination result in step S52 is "No", whether the tag code read in step S51 is "0" or not is determined (step S59).

If the determination result in step S59 is "Yes", the control in this case is ended after executing step S58.

If the determination result in step S59 is "No", the rotation control unit 60 issues a command to the table drive mechanism to completely stop the turntable 2 (step S510). Then, the punch control unit 65 issues a command to the punch drive mechanism 100 to stop the upper punch (step S511). Step S510 and step S511 are out of order and those steps may be executed at the same time. The control in this case is then ended. The reason why the determination result in step S59 is "No" resides in that the turntable 2 has been manually moved to an improper position by mistake after it stopped due to malfunction. After the complete stop of the turntable 2, the turntable 2 is manually moved in a direction opposite to the direction of the previous manual operation, and the sizing device 1 is restarted.

If the condition in step S56 is not satisfied, whether the measured value is over the upper limit value of the setting range or not is determined (step S512).

If the condition in step S512 is satisfied, the shaping position input unit 45*w* inputs "3" to the identification information holding unit 22 (step S513). Then, the control in this case is ended after executing step S510 and step S511.

If the condition in step S512 is not satisfied, the shaping position input unit 45*w* inputs "4" to the identification information holding unit 22 (step S514). Then, the control in this case is ended after executing step S510 and step S511.

Figure 5:
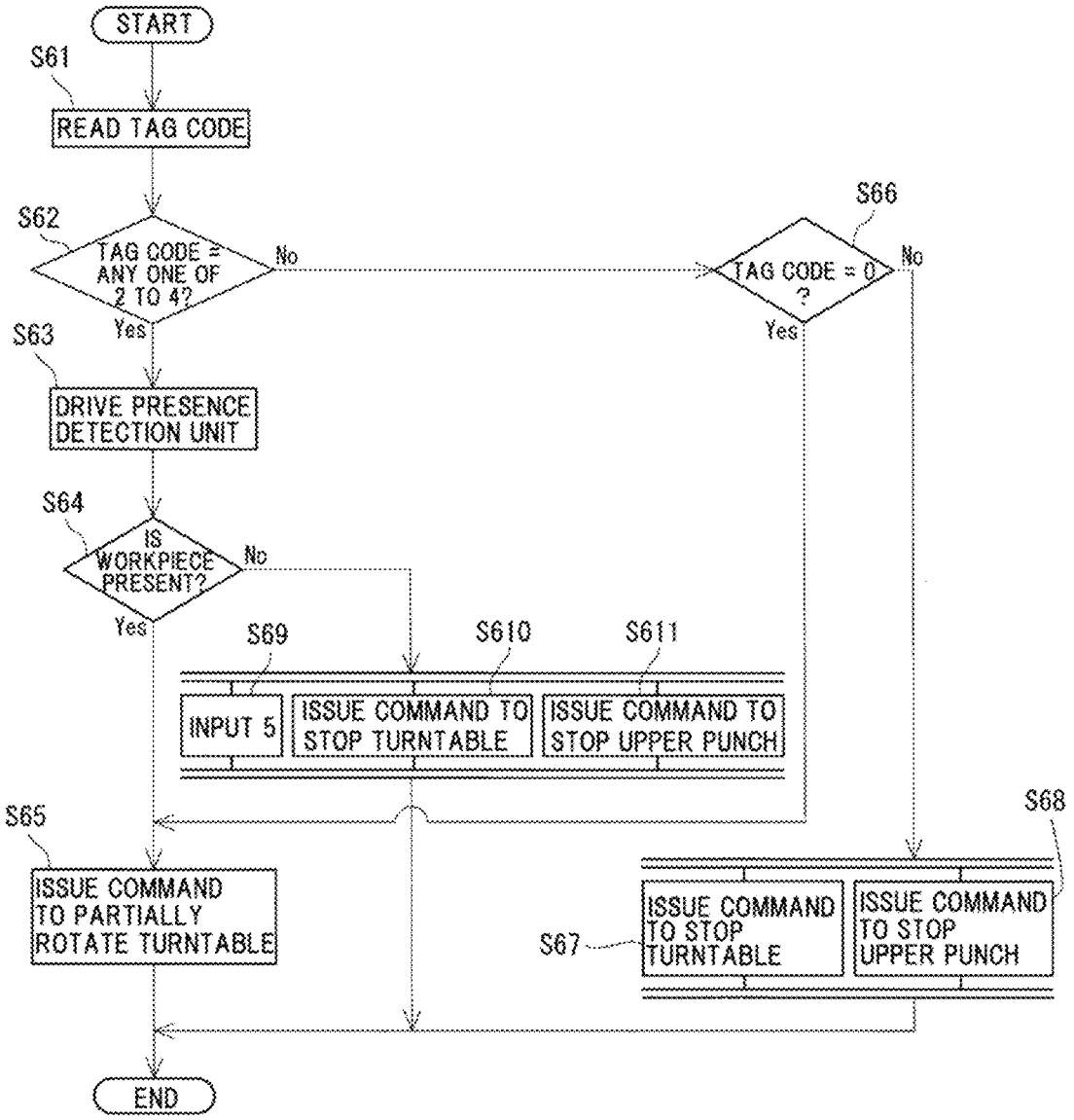
FIG. 5 is a flowchart illustrating a control procedure at a workpiece post-shaping position in the sizing device according to the exemplary embodiment.

(Control Procedure at Workpiece Post-Shaping Position: FIG. 5)

The post-shaping read unit 46*r* reads the tag code held in the identification information holding unit 22 (step S61). The information processing unit 6 determines whether the tag code read in step S61 is any one of "2" to "4" (step S62).

If the condition in step S62 is satisfied, the presence detection control unit 66 drives the presence detection unit 56 to detect the presence or the absence of the workpiece W in the accommodation hole 21*h* (step S63). Then, the presence determination unit 661 determines, based on the detection result in step S63, whether the workpiece W is present or absent (step S64).

If the determination result in step S64 is "Yes (present)", the rotation control unit 60 issues a command to the table drive mechanism to partially rotate the turntable 2 (step S65). The control in this case is then ended.

If the condition in step S62 is not satisfied, whether the tag code read in step S61 is "0" or not is determined (step S66).

If the determination result in step S66 is "Yes", the control in this case is ended after executing step S65.

If the determination result in step S66 is "No", the rotation control unit 60 issues a command to the table drive mechanism to completely stop the turntable 2 (step S67). Then, the punch control unit 65 issues a command to the punch drive mechanism 100 to stop the upper punch (step S68). Step S67 and step S68 are out of order and those steps may be executed at the same time. The control in this case is then ended. The reason why the determination result in step S66 is "No" resides in that the turntable 2 has been manually moved to an improper position by mistake after it stopped due to malfunction. Accordingly, after the complete stop of the turntable 2, the turntable 2 is manually moved to a proper position by moving it in a direction opposite to the direction of the previous manual operation, and the sizing device 1 is restarted.

If the determination result in step S64 is "No (absent)", the post-shaping input unit 46*w* inputs "5" to the identification information holding unit 22 (step S69). Then, as in step S67 and step S68, the rotation control unit 60 issues a command to the table drive mechanism to completely stop the turntable 2 (step S610), and the punch control unit 65 issues a command to the punch drive mechanism 100 to stop the upper punch (step S611). Step S69 to step S611 are out of order and those steps may be executed at the same time. The control in this case is then ended. The reason why the determination result in step S64 is "No (absent)" resides in that the turntable 2 is normally rotated while the workpiece W remains sticking to the upper punch. Accordingly, the above control can make it possible to determine whether the workpiece W having been pressed by the upper and lower punches remains sticking to the upper punch, and to prevent the next workpiece W from being pressed by the upper punch in the state in which the preceding workpiece W remains sticking to the upper punch. This is because the turntable 2 can be stopped before the next sizing is performed in the state in which the workpiece W remains sticking to the upper punch. After the complete stop of the turntable 2, the workpiece W sticking to the upper punch is manually accommodated into the accommodation hole 21*h* at 6*st*, and the sizing device 1 is restarted.

Figure 6:
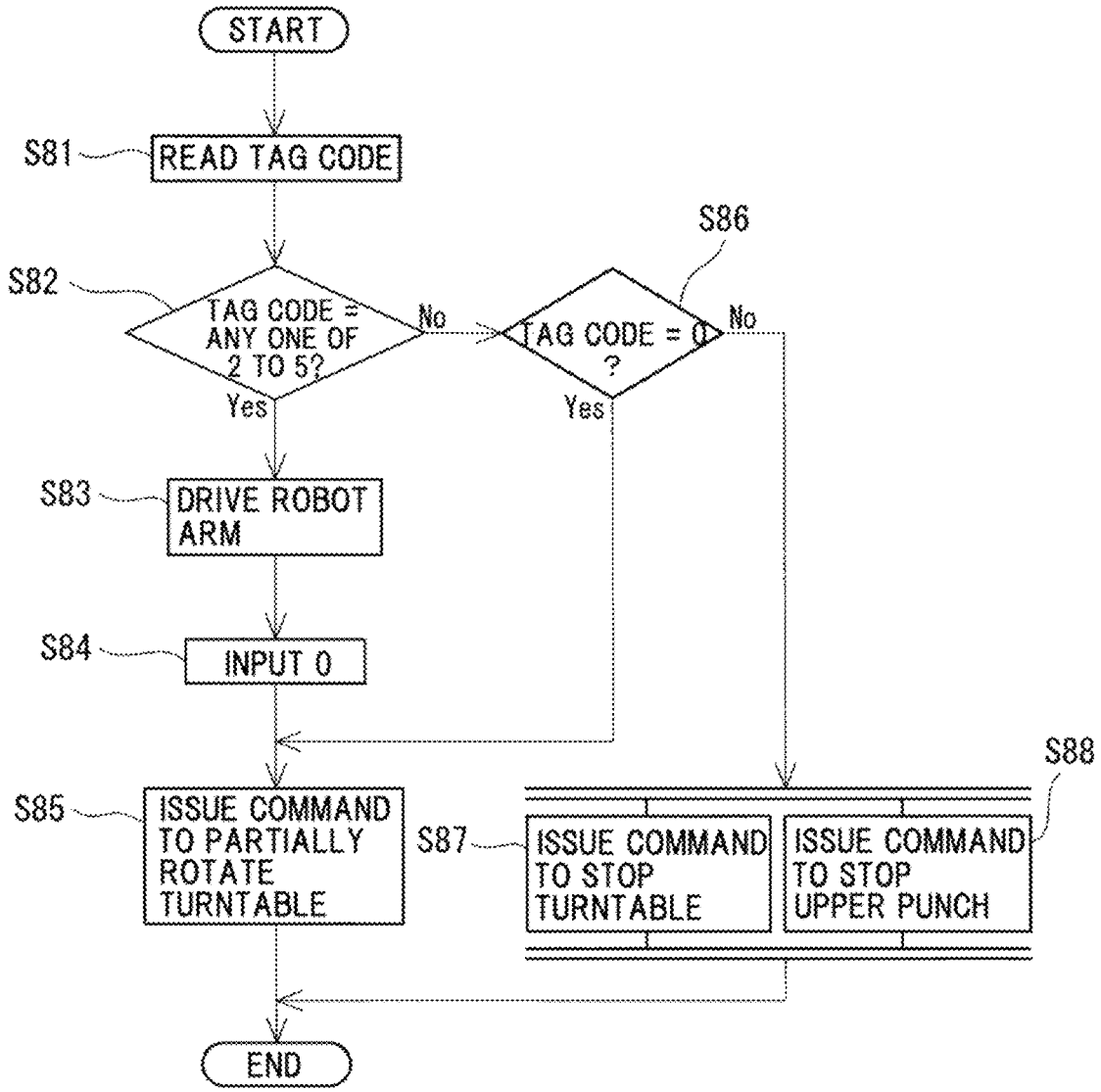
FIG. 6 is a flowchart illustrating a control procedure at a workpiece taking-out position in the sizing device according to the exemplary embodiment.

(Control Procedure at Workpiece Taking-Out Position: FIG. 6)

The taking-out-side read unit 48*r* reads the tag code held in the identification information holding unit 22 (step S81).

The information processing unit 6 determines whether the tag code read in step S81 is any one of "2" to "5" (step S82).

Although not illustrated, step S82 is executed if, as a result of determining whether the accommodation date of the workpiece W and the number of the accommodated workpiece W, which are input to the identification information holding unit 22 and read by the taking-out-side read unit 48*r*, are proper or not, the determination result is proper. If the determination result is improper, the control in this case is ended after executing later-described step S87 and step S88. The determination regarding whether the accommodation date of the workpiece W and the number of the accommodated workpiece W input to the identification information holding unit 22 are proper or not can be made by determining whether the read tag code matches (or does not match) with a check tag code. The check tag code is obtained by, in accordance with the number and the layout of the accommodation holes 21*h* of the turntable 2, computing information regarding a rotation position of the accommodation hole 21*h* that has been moved from the workpiece supply position F to the workpiece taking-out position E. The obtained check tag code is stored in the storage unit 68. Here, because the eight accommodation holes 21*h* are arranged at equal intervals and the basic rotation angle is 45° (basic rotation angle is assumed to be one unit of partial rotation) the information regarding the rotation position of the accommodation hole 21*h* moved from the workpiece supply position F to the workpiece taking-out position E is 315° (seven partial rotations). In other words, the storage unit 68 stores the accommodation date of the workpiece W and the number of the accommodated workpiece W, which have been input to the identification information holding unit 22 by the supply-side input unit 41*w* in step S14 (see FIG. 2), as the check tag code after the rotation through 315° (after seven partial rotations).

If the condition in step S82 is satisfied, the robot hand control unit drives the robot hand to take out the workpiece W in the accommodation hole 21*h* (step S83). Then, the taking-out-side input unit 48*w* receives a signal sent from the robot hand and inputs "0" to the identification information holding unit 22 (step S84). Then, the rotation control unit 60 issues a command to the table drive mechanism to partially rotate the turntable 2 once (step S85). The control in this case is then ended.

If the condition in step S82 is not satisfied, whether the tag code read in step S81 is "0" or not is determined (step S86).

If the determination result in step S86 is "Yes", the control in this case is ended after executing step S85.

If the determination result in step S86 is "No", the rotation control unit 60 issues a command to the table drive mechanism to completely stop the turntable 2 (step S87). Then, the punch control unit 65 issues a command to the punch drive mechanism 100 to stop the upper punch (step S88). Step S87 and step S88 are out of order and those steps may be executed at the same time. The control in this case is then ended. The reason why the determination result in step S86 is "No" resides in that the turntable 2 has been manually moved to an improper position by mistake after it stopped due to malfunction. After the complete stop of the turntable 2, the turntable 2 is manually moved in a direction opposite to the direction of the previous manual operation, and the sizing device 1 is restarted.

(Other Control Procedures, not Illustrated)

The torque measurement unit measures rotation torque of the turntable 2 (step Sα). The torque determination unit determines whether a value measured in step Sα is over an upper limit of the setting range or not (step Sβ). If the condition in step Sβ is satisfied, each of the shaping position input unit 45*w* and the post-shaping input unit 46*w* inputs "8" to the identification information holding unit 22 (step Sγ). Then, the rotation control unit 60 issues a command to the table drive mechanism to completely stop the turntable 2 (step SS). Step Sγ and step Sδ are out of order and those steps may be executed at the same time. The control in this case is then ended. If the condition in step SP is not satisfied, the rotation control unit 60 issues a command to the table drive mechanism to partially rotate the turntable 2 once (step Sε). The control in this case is then ended.

(Applications)

The sizing device 1 according to the embodiment can be suitably utilized to correct sizes of sintered bodies in a production process for sintered parts.

Advantageous Effects

With the sizing device 1 according to the embodiment, an unsized product and a multiple-sized product can be avoided from being carried to the downstream side in the sizing device 1 with no need of the manual work of recovering the workpieces W on the turntable 2. The reason resides in that the tag code makes it possible to not only determine whether each workpiece W is a press completed product or not, but also to recognize that the turntable 2 has been stopped due to malfunction and manually moved to an improper position by mistake, and that passage of the unsized product through the workpiece shaping position S and production of the multiple-sized product can be avoided. In addition, by utilizing the tag code, it can be determined that the product after the sizing is which one of the sizing-pressure proper product, the sizing-pressure excessive product, and the sizing-pressure insufficient product.

The present disclosure is not limited to the above-described embodiments, is defined in Claims, and is intended to include all of the modifications that are equivalent to the scope of Claims and fall within the scope of Claims.

For example, a plurality of identification information holding units corresponding to the individual accommodation holes of the turntable and storing the accommodation date of the workpiece, the number of the accommodated workpiece, the preset numeral indicating, for example, the state of the workpiece, and so on may be disposed in the storage unit of the information processing unit equipped in the press main body instead of being disposed on the turntable at positions near the accommodation holes. In such a case, the individual input units and read units are all disposed in the information processing unit. As an alternative, a plurality of identification information holding units corresponding to the individual accommodation holes of the turntable and storing the numeral indicating, for example, the state of the workpiece, may be disposed in the storage unit of the information processing unit equipped in the press main body, while a plurality of identification information holding units corresponding to the individual accommodation holes of the turntable and storing the accommodation date of the workpiece and the number of the accommodated workpiece may be disposed on the turntable at positions near the accommodation holes in a one-to-one relation. In such a case, the individual input units and read units respectively inputting and reading the numeral indicating, for example, the state of the workpiece are all disposed in the information processing unit, while the individual input units and read units respectively inputting and reading the accommodation date of the workpiece and the number of the accommodated workpiece are disposed outside (or inside) the turntable.

With the above-described arrangement, the sizing device can be instantly stopped, for example, when the detection result of the propriety detection unit is improper or when the detection result of the presence detection unit is "No (absent)" under condition that the turntable is stopped.

Figure 7:
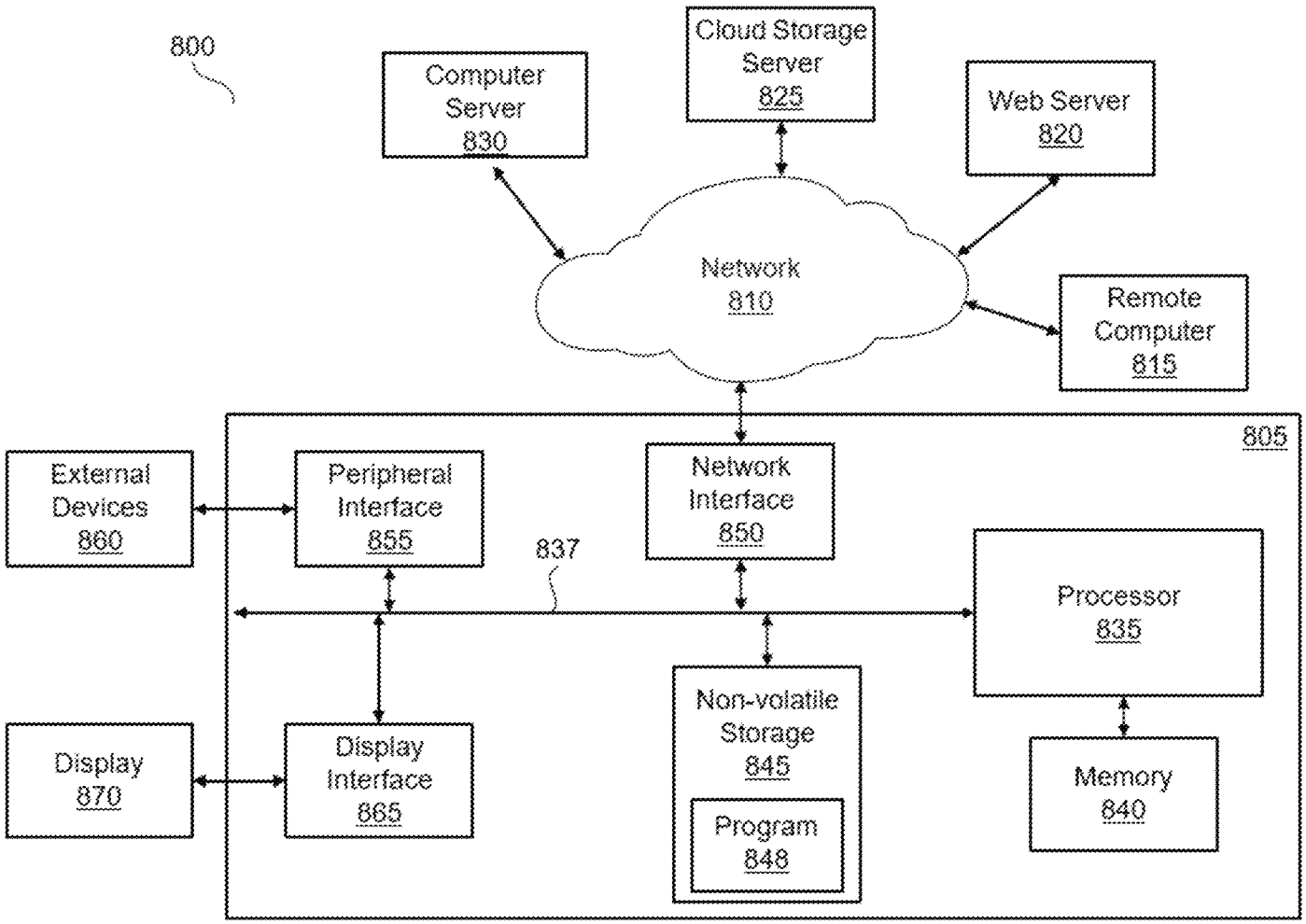
FIG. 7 is a diagram of control circuitry that performs control operations according to the present disclosure.

FIG. 7 illustrates a block diagram of a computer that may implement the various embodiments described herein.

The present disclosure may be embodied as a system, a method, and/or a computer program product. The computer program product may include a computer readable storage medium on which computer readable program instructions are recorded that may cause one or more processors to carry out aspects of the embodiment.

The computer readable storage medium may be a tangible device that can store instructions for use by an instruction execution device (processor). The computer readable storage medium may be, for example, but is not limited to, an electronic storage device, a magnetic storage device, an optical storage device, an electromagnetic storage device, a semiconductor storage device, or any appropriate combination of these devices. A non-exhaustive list of more specific examples of the computer readable storage medium includes each of the following (and appropriate combinations): flexible disk, hard disk, solid-state drive (SSD), random access memory (RAM), read-only memory (ROM), erasable programmable read-only memory (EPROM or Flash), static random access memory (SRAM), compact disc (CD or CD-ROM), digital versatile disk (DVD) and memory card or stick. A computer readable storage medium, as used in this disclosure, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described in this disclosure can be downloaded to an appropriate computing or processing device from a computer readable storage medium or to an external computer or external storage device via a global network (i.e., the Internet), a local area network, a wide area network and/or a wireless network. The network may include copper transmission wires, optical communication fibers, wireless transmission, routers, firewalls, switches, gateway computers and/or edge servers. A network adapter card or network interface in each computing or processing device may receive computer readable program instructions from the network and forward the computer readable program instructions for storage in a computer readable storage medium within the computing or processing device.

Computer readable program instructions for carrying out operations of the present disclosure may include machine language instructions and/or microcode, which may be compiled or interpreted from source code written in any combination of one or more programming languages, including assembly language, Basic, Fortran, Java, Python, R, C, C++, C # or similar programming languages. The computer readable program instructions may execute entirely on a user's personal computer, notebook computer, tablet, or smartphone, entirely on a remote computer or computer server, or any combination of these computing devices. The remote computer or computer server may be connected to the user's device or devices through a computer network, including a local area network or a wide area network, or a global network (i.e., the Internet). In some embodiments, electronic circuitry including, for example, programmable logic circuitry, field-programmable gate arrays (FPGA), or programmable logic arrays (PLA) may execute the computer readable program instructions by using information from the computer readable program instructions to configure or customize the electronic circuitry, in order to perform aspects of the present disclosure.

Aspects of the present disclosure are described herein with reference to flow diagrams and block diagrams of methods, apparatus (systems), and computer program products according to embodiments of the disclosure. It will be understood by those skilled in the art that each block of the flow diagrams and block diagrams, and combinations of blocks in the flow diagrams and block diagrams, can be implemented by computer readable program instructions.

The computer readable program instructions that may implement the systems and methods described in this disclosure may be provided to one or more processors (and/or one or more cores within a processor) of a general purpose computer, special purpose computer, or other programmable apparatus to produce a machine, such that the instructions, which execute via the processor of the computer or other programmable apparatus, create a system for implementing the functions specified in the flow diagrams and block diagrams in the present disclosure. These computer readable program instructions may also be stored in a computer readable storage medium that can direct a computer, a programmable apparatus, and/or other devices to function in a particular manner, such that the computer readable storage medium having stored instructions is an article of manufacture including instructions which implement aspects of the functions specified in the flow diagrams and block diagrams in the present disclosure.

The computer readable program instructions may also be loaded onto a computer, other programmable apparatus, or other device to cause a series of operational steps to be performed on the computer, other programmable apparatus or other device to produce a computer implemented process, such that the instructions which execute on the computer, other programmable apparatus, or other device implement the functions specified in the flow diagrams and block diagrams in the present disclosure.

FIG. 7 is a functional block diagram illustrating a networked system 800 of one or more networked computers and servers. In an embodiment, the hardware and software environment illustrated in FIG. 7 may provide an exemplary platform for implementation of the software and/or methods according to the present disclosure.

Referring to FIG. 7, a networked system 800 may include, but is not limited to, computer 805, network 810, remote computer 815, web server 820, cloud storage server 825 and computer server 830. In some embodiments, multiple instances of one or more of the functional blocks illustrated in FIG. 7 may be employed.

Additional detail of computer 805 is shown in FIG. 7. The functional blocks illustrated within computer 805 are provided only to establish exemplary functionality and are not intended to be exhaustive. And while details are not provided for remote computer 815, web server 820, cloud storage server 825 and computer server 830, these other computers and devices may include similar functionality to that shown for computer 805.

Computer 805 may be a personal computer (PC), a desktop computer, laptop computer, tablet computer, netbook computer, a personal digital assistant (PDA), a smart phone, or any other programmable electronic device capable of communicating with other devices on network 810.

Computer 805 may include processor 835, bus 837, memory 840, non-volatile storage 845, network interface 850, peripheral interface 855 and display interface 865. Each of these functions may be implemented, in some embodiments, as individual electronic subsystems (integrated circuit chip or combination of chips and associated devices), or, in other embodiments, some combination of functions may be implemented on a single chip (sometimes called a system on chip or SoC).

Processor 835 may be one or more single or multi-chip microprocessors, such as those designed and/or manufactured by Intel Corporation, Advanced Micro Devices, Inc. (AMD), Arm Holdings (Arm), Apple Computer, etc. Examples of microprocessors include Celeron, Pentium. Core i3, Core i5 and Core i7 from Intel Corporation; Opteron, Phenom, Athlon, Turion and Ryzen from AMD; and Cortex-A, Cortex-R and Cortex-M from Arm. Bus 837 may be a proprietary or industry standard high-speed parallel or serial peripheral interconnect bus, such as ISA, PCI, PCI Express (PCI-e), AGP, and the like. Memory 840 and non-volatile storage 845 may be computer-readable storage media. Memory 840 may include any suitable volatile storage devices such as Dynamic Random Access Memory (DRAM) and Static Random Access Memory (SRAM). Non-volatile storage 845 may include one or more of the following: flexible disk, hard disk, solid-state drive (SSD), read-only memory (ROM), erasable programmable read-only memory (EPROM or Flash), compact disc (CD or CD-ROM), digital versatile disk (DVD) and memory card or stick.

Program 848 may be a collection of machine readable instructions and/or data that is stored in non-volatile storage 845 and is used to create, manage, and control certain software functions that are discussed in detail elsewhere in the present disclosure and illustrated in the drawings. In some embodiments, memory 840 may be considerably faster than non-volatile storage 845. In such embodiments, program 848 may be transferred from non-volatile storage 845 to memory 840 prior to execution by processor 835.

Computer 805 may be capable of communicating and interacting with other computers via network 810 through network interface 850. Network 810 may be, for example, a local area network (LAN), a wide area network (WAN) such as the Internet, or a combination of the two, and may include wired, wireless, or fiber optic connections. In general, network 810 can be any combination of connections and protocols that support communications between two or more computers and related devices.

Peripheral interface 855 may allow for input and output of data with other devices that may be connected locally with computer 805. For example, peripheral interface 855 may provide a connection to external devices 860. External devices 860 may include devices such as a keyboard, a mouse, a keypad, a touch screen, and/or other suitable input devices. External devices 860 may also include portable computer-readable storage media such as, for example, thumb drives, portable optical or magnetic disks, and memory cards. Software and data used to practice embodiments of the present disclosure, for example, program 848, may be stored on such portable computer-readable storage media. In such embodiments, software may be loaded onto non-volatile storage 845 or, alternatively, directly into memory 840 via peripheral interface 855. Peripheral interface 855 may use an industry standard connection, such as RS-232 or Universal Serial Bus (USB), to connect with external devices 860.

Display interface 865 may connect computer 805 to display 870. Display 870 may be used, in some embodiments, to present a command line or graphical user interface to a user of computer 805. Display interface 865 may connect to display 870 using one or more proprietary or industry standard connections, such as VGA, DVI, DisplayPort and HDMI.

As described above, network interface 850, provides for communications with other computing and storage systems or devices external to computer 805. Software programs and data discussed herein may be downloaded from, for example, remote computer 815, web server 820, cloud storage server 825 and computer server 830 to non-volatile storage 845 through network interface 850 and network 810. Furthermore, the systems and methods described in this disclosure may be executed by one or more computers connected to computer 805 through network interface 850 and network 810. For example, in some embodiments the systems and methods described in this disclosure may be executed by remote computer 815, computer server 830, or a combination of the interconnected computers on network 810.

Data, datasets and/or databases employed in embodiments of the systems and methods described in this disclosure may be stored and or downloaded from remote computer 815, web server 820, cloud storage server 825 and computer server 830.

REFERENCE SIGNS LIST

1 sizing device
2 turntable
**21*h*** accommodation hole
22 identification information holding unit (ID storage medium)
25 connection base
3 die set
31 die
**31*h*** through hole
35 die plate
**41*r*** supply-side read unit (supply-side reader)
**41*w*** supply-side input unit (supply-side source)
**43*r*** pre-shaping read unit (pre-shaping reader)
**45*r*** shaping position read unit (shaping position reader)
**45*w*** shaping position input unit (shaping position source)
**46*r*** post-shaping read unit (post-shaping reader)
**46*w*** post-shaping input unit (post-shaping source)
**48*r*** taking-out-side read unit (taking-out-side reader)
**48*w*** taking-out-side input unit (taking-out-side source)
53 propriety detection unit (propriety detector, or detector)
55 pressure measurement unit (pressure sensor)
56 presence detection unit (presence sensor)
6 information processing unit (processing circuitry, processor, or circuitry)
60 rotation control unit (rotation controller)
63 propriety detection control unit (propriety detection controller)
631 propriety determination unit (propriety determination detector)
65 punch control unit (punch controller)
66 presence detection control unit (punch detection controller)
661 presence determination unit (presence detector)
68 storage unit (memory)
100 punch drive mechanism (punch driver)
W workpiece
F workpiece supply position
B workpiece pre-shaping position
S workpiece shaping position
A workpiece post-shaping position
E workpiece taking-out position

The invention claimed is:

1. A sizing device comprising:

a turntable having a plurality of accommodation holes that accommodate workpieces and that carry a respective workpiece in each of the accommodation holes to a through hole of a die disposed at a workpiece shaping position one by one, and cause the workpiece to be pressed by upper and lower punches that are vertically movable, while each of the accommodation holes is moved from a workpiece supply position to a workpiece taking-out position by the turntable being rotated about a rotation axis;

a plurality of identification (ID) media that are disposed on the turntable and that correspond to the accommodation holes of the turntable and are configured to respectively store tag codes;

a supply-side source that inputs a tag code to an ID medium, of the plurality of ID media, corresponding to an accommodation hole at the workpiece supply position when the workpiece is accommodated into the accommodation hole at the workpiece supply position;

a shaping position reader that reads a tag code in the ID medium corresponding to the accommodation hole at the workpiece shaping position;

a punch controller that controls driving of the upper and lower punches to be inserted into the through hole of the die and to press the workpiece in the through hole in accordance with the tag code read by the shaping position reader; and a shaping position source that inputs a new tag code to the ID medium corresponding to the accommodation hole at the workpiece shaping position upon completion of pressing by the upper and lower punches, wherein the shaping position source is configured to input the new tag code to the ID medium corresponding to the accommodation hole at the workpiece shaping position when the driving of the upper and lower punches is started.

2. The sizing device according to claim 1, further comprising:

a pressure sensor configured to measure a pressing force of the punches, wherein the new tag code input by the shaping position source is a tag code in accordance with a value measured by the pressure sensor.

3. The sizing device according to claim 1, further comprising:

a post-shaping reader that reads a tag code input to the ID medium corresponding to the accommodation hole that is located downstream of the workpiece shaping position and upstream of the workpiece taking-out position;

a presence detector that detects, based on a result read by the post-shaping reader, a presence or an absence of the workpiece in the accommodation hole corresponding to the ID medium from which the tag code has been read by the post-shaping reader; and a rotation controller configured to stop rotation of the turntable in accordance with a detection result of the presence detector, in addition to the punch controller that stops vertical movement of the upper and lower punches in accordance with the detection result of the presence detector.

4. The sizing device according to claim 3, further comprising:

a post-shaping source that inputs, in accordance with the detection result of the presence detector, a new tag code to the ID medium corresponding to the accommodation hole that has been subjected to the detection by the presence detector.

5. The sizing device according to claim 1, further comprising:

a pre-shaping reader that reads a tag code input to the ID medium corresponding to the accommodation hole that is located downstream of the workpiece supply position and upstream of the workpiece shaping position;

a propriety detector that detects, based on a result read by the pre-shaping reader, whether an accommodation state of the workpiece in the accommodation hole corresponding to the ID medium from which the tag code has been read by the pre-shaping reader is proper or not; and a rotation controller configured to stop rotation of the turntable in accordance with a detection result of the propriety detector, in addition to the punch controller that stops vertical movements of the upper and lower punches in accordance with the detection result of the presence detector.

6. The sizing device according to claim 1, further comprising:

a taking-out-side reader that reads a tag code input to the ID medium corresponding to the accommodation hole at the workpiece taking-out position; and a storage medium that stores the tag code having been read by the taking-out-side reader.

7. The sizing device according to claim 1, further comprising:

a die set that includes the die and the upper and lower punches, wherein the turntable is disposed on a same side as the die set, not on a same side as a press main body including a punch drive mechanism that drives the upper and lower punches.

8. The sizing device according to claim 1, wherein the plurality of ID media comprise non-transitory computer storage media.

9. The sizing device according to claim 1, wherein the shaping position reader is configured to read the tag code without contacting the ID medium in which the tag code is stored.

10. The sizing device according to claim 9, wherein the shaping position reader and the ID medium communicate via near-field communication.

11. The sizing device according to claim 9, wherein the shaping position reader and the ID medium communicate via Bluetooth communication.

12. The sizing device according to claim 1, wherein the plurality of ID media are disposed about a periphery of the turntable at a uniform angular interval.

13. The sizing device according to claim 1, wherein the plurality of accommodation holes are positioned in the turntable at the same uniform angular interval as the plurality of ID media.

14. The sizing device according to claim 1, further comprising an abnormality detector configured to detect an abnormality in rotation of the turntable.

15. The sizing device according to claim 14, wherein the abnormality detector is configured to detect the abnormality in the rotation of the turntable based on rotation torque measurements of the turntable.

16. The sizing device according to claim 14, wherein the abnormality detector is configured to detect the abnormality in the rotation of the turntable when a torque measurement of the turntable exceeds a predetermine upper limit.

17. The sizing device according to claim 14, further comprising a user interface to output an indication of the abnormality detected by the abnormality detector.

18. The sizing device according to claim 17, wherein the user interface includes at least a display device to display a warning corresponding to the abnormality detected by the abnormality detector.

19. The sizing device according to claim 18, wherein the user interface further includes a speaker to output an audible warning corresponding to the abnormality detected by the abnormality detector.

* * * * *